US006379416B1

(12) United States Patent
Nakahara et al.

(10) Patent No.: US 6,379,416 B1
(45) Date of Patent: Apr. 30, 2002

(54) METHOD AND DEVICE FOR MELT-TREATING INCINERATION RESIDUE CONTAINING SALTS

(75) Inventors: Keisuke Nakahara; Satoshi Matsui; Takuya Shinagawa, all of Tokyo (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/403,611

(22) PCT Filed: Jul. 22, 1999

(86) PCT No.: PCT/JP99/03924

§ 371 Date: Jan. 3, 2000

§ 102(e) Date: Jan. 3, 2000

(87) PCT Pub. No.: WO00/16009

PCT Pub. Date: Mar. 23, 2000

(30) Foreign Application Priority Data

| | | |
|---|---|---|
| Sep. 11, 1998 | (JP) | 10-257890 |
| Oct. 1, 1998 | (JP) | 10-279903 |
| Dec. 18, 1998 | (JP) | 10-360107 |

(51) Int. Cl.[7] ..... C22B 7/00

(52) U.S. Cl. ..... 75/10.46; 266/201; 266/236; 266/216; 266/218; 75/416

(58) Field of Search ..... 75/10.46, 416; 266/201, 236, 218, 216

(56) References Cited

U.S. PATENT DOCUMENTS

| | | | | |
|---|---|---|---|---|
| 3,598,649 | A | * | 8/1971 | Juhasz |
| 4,201,141 | A | | 5/1980 | Teodorescu et al. |
| 4,629,509 | A | * | 12/1986 | O'Hara et al. ..... 106/118 |
| 4,829,911 | A | * | 5/1989 | Mielson ..... 110/234 |
| 5,222,448 | A | * | 6/1993 | Morgenthaler et al. ..... 110/346 |
| 5,535,234 | A | * | 7/1996 | Bullmann ..... 373/8 |
| 6,084,903 | A | * | 7/2000 | Fukushima et al. ..... 373/121 |

FOREIGN PATENT DOCUMENTS

| | | | |
|---|---|---|---|
| JP | 40-5523 | A | 3/1965 |
| JP | 52-150784 | A | 12/1977 |
| JP | 53-129463 | A | 11/1978 |
| JP | 1-61530 | | 4/1989 |
| JP | 6-193853 | A | 7/1994 |
| JP | 7-155728 | A | 6/1995 |
| JP | 7-174325 | A | 7/1995 |
| JP | 7-225013 | A | 8/1995 |
| JP | 8-28851 | A | 2/1996 |
| JP | 9-166309 | A | 6/1997 |
| JP | 10-38247 | | 2/1998 |
| JP | 10-38248 | | 2/1998 |
| JP | 10-89658 | | 4/1998 |
| JP | 10-205728 | A | 8/1998 |
| WO | WO-972914 | A1 * | 8/1997 |

OTHER PUBLICATIONS

AltaVista® translation of p. 4, lines 20–25 of WO 97/292214 published Aug. 14, 1997 by Edlinger.*

* cited by examiner

*Primary Examiner*—Roy King
*Assistant Examiner*—Tima McGuthry Banks
(74) *Attorney, Agent, or Firm*—Frishauf, Holtz, Goodman, Langer & Chick, P.C.

(57) ABSTRACT

A component adjustor is added to an incineration residue containing salts to adjust a component ratio determined by the equation (Ca+Mg)/(Si+Al) in the range of 0.7 to 2.0. The incineration residue having the adjusted component ratio is charged to a melting furnace maintained in a reducing atmosphere to form a melt. The melt is separated into a molten slag layer, a molten salt layer, and a molten metal layer. The molten slag is fractionated and discharged from the melting furnace. The discharged molten slag is rapidly cooled. The temperature of the vapor phase in the melting furnace is maintained at 700 to 1000° C. A non-oxidizing gas is blown into the vapor phase in the melting furnace to increase the amounts of exhaust gases exhausted from the melting furnace.

16 Claims, 15 Drawing Sheets

METHOD AND DEVICE FOR MELT-TREATING INCINERATION RESIDUE CONTAINING SALTS

TECHNICAL FIELD

Present invention relates to a method for melting an incineration residue containing salts such as an incineration residue of municipal solid waste or the like, and an apparatus therefor.

BACKGROUND ART

In disposal of incineration residues produced by incineration of municipal solid waste, industrial waste and the like, there is an obligation to make some heavy metals insoluble. There is also demand for decreasing the volume of the incineration residue with tightness of final disposal spots. Therefore, as processing for making heavy metals in the incineration residue insoluble, and decreasing the volume of the incineration residue, melting is carried out.

Various melting furnaces are used for melting incineration residues, which include a melting furnace in which a reducing atmosphere is maintained, for example, an electric resistance melting furnace for melting, as disclosed in Japanese Unexamined Patent Publication No. 7-225013. In melting using such a melting furnace, an incineration residue is put in the melting furnace in which a reducing atmosphere is maintained, and temporarily stayed in the melting furnace to be separated into molten slag mainly comprising oxides, and molten salts comprising salts such as chlorides and the like, so that the molten slag and the molten salts are separately discharged.

However, when an incineration residue containing salts is melted in the melting furnace in which a reducing atmosphere is maintained, the obtained slag contains a large amount of chlorine in spite of the separate discharges of the molten slag and the salts. The slag produced under such processing conditions contains several percentages of chlorine depending upon the composition thereof. Since the slag is in a state in which chloride is readily eluted, a large amount of chlorine is eluted in an elution test of the slag. It is thus predicted that the use of the slag as aggregate for civil engineering and construction causes various problems of metal corrosion, etc. Therefore, the slag is not used as the aggregate.

When the slag obtained by melting the incineration residue is used as aggregate for civil engineering and construction, there is now no standard for the chlorine content. However, the content of chlorine ions is 0.02% or less under JIS standards (R5210) for portland cement, and a value of less than 0.01% (100 mg/kg) is required in industry. This industrial requirement value corresponds to 10 mg/l in terms of the concentration of chlorine eluted in the elution test according to the method of deciding soil environment standards (Notification No. 46 of Environment Agency). Therefore, on the basis of the industrial requirement value of portland cement quality, the upper limit of the allowable concentration of eluted chlorine of slag is thought to be 10 mg/l.

According to the test results obtained by the inventors, as shown in FIG. 6, as the chlorine content increases, the amount of eluted chlorine of slag increases. Therefore, in order to keep the concentration of eluted chloride at the above value (10 kg/l) or less, the chlorine content of slag must be decreased to 1% or less. However, particularly, when an incineration residue containing salts is processed by the above-described method in which it is melted in a reducing atmosphere, and then temporarily stayed in the furnace, a large amount of chlorine is mixed in slag, causing difficulties in decreasing the chlorine content to 1% or less.

On the other hand, the molten slag in the melting furnace is present on a high-temperature molten slag layer mainly comprising oxides having melting points of 1300 to 1500° C., and the molten salt layer is consequently heated to a high temperature. When the molten slat layer is heated to a high temperature, low-boiling-point substances contained in the molten salt layer, such as alkali metal salts such as sodium chloride, potassium chloride, and the like, and chlorides of heavy metals such as zinc, lead, cadmium, and the like, are vaporized because of their relatively low boiling points.

At this time, the melt in the furnace is covered with the unmelted incineration residue which functions as a thermal insulating layer for preventing upward heat transfer from the high-temperature melt, and thus the temperature of the vapor phase in the furnace is very lower than the temperature of the melt. Therefore, the vaporized low-boiling-point substances are condensed and solidified by cooling in the vapor phase, and discharged as dust together with exhaust gases.

The above-mentioned vaporization of the low-boiling-point substances causes the occurrence of a large amount of dust mainly comprising chlorides of alkali metals, causing various troubles in the exhaust gas processing system. Namely, of the low-boiling-point substances, alkali metal salts have adhesion, and thus adhere to an exhaust gas duct to cause clogging, and promote clogging of a dust collector, causing the problem of deteriorating the processing capacity. This causes a trouble in the continuous operation of the melting furnace.

Furthermore, when the molten salts stayed in the furnace are discharged, the molten salts on the molten slag layer cannot be completely discharged in order to prevent contamination with the molten slag. Therefore, the molten salt layer is present to some extent in the furnace. As a result, various problems occur due to the presence of the molten salt layer.

First, the production of the molten salt layer in the furnace causes erosion of the furnace wall refractory of a portion in contact with the molten salts to increase the repair cost of the furnace. Of the above-described conventional techniques, the method using an electric resistance melting furnace causes a short circuit phenomenon that a current flowing between electrodes is concentrated in the molten salt layer with a low electric resistance because the electric resistance value of the molten salts is lower than the value of the molten slag. As a result, the temperature of the molten slag layer cannot be maintained at a predetermined value, causing difficulties in discharging the molten slag.

DISCLOSURE OF INVENTION

It is an object of the present invention to provide a method for melting an incineration residue containing salts, which is capable of suppressing elution of chlorine, and obtaining slag for aggregate containing no metal.

It is another object of the present invention to provide a method of melting an incineration residue and an apparatus for carrying out the method, which are capable of suppressing the production of alkali metal dust even in melting an incineration residue containing salts, thereby causing no trouble in an operation of an exhaust gas processing apparatus.

It is a further object of the present invention to provide a method of melting an incineration residue and an apparatus for carrying out the method, which produce substantially no molten salt layer in a melting furnace even in melting an incineration residue containing salts.

In order to achieve the objects, first, the present invention provides a method for melting an incineration residue containing salts, comprising the steps:

adding a component adjustor to the incineration residue containing salts to adjust a component ratio determined by the following equation in the range of 0.7 to 2.0;

Component ratio (molar ratio)=(Ca+Mg)/(Si+Al) charging the incineration residue having the adjusted component ratio to a melting furnace maintained in a reducing atmosphere, and melting the incineration residue to form a melt;

staying the melt in the melting furnace to separate the melt into a molten slag layer, a molten salt layer, and a molten metal layer;

fractionating the molten slag and discharging it; and rapidly cooling the discharged molten slag.

Secondarily, the present invention provides a method for melting an incineration residue containing salts, comprising the steps of:

charging an incineration residue containing salts to a melting furnace containing a melt;

melting the incineration residue; and maintaining the temperature of the vapor phase in the melting furnace to 700 to 1000° C.

Thirdly, the present invention provides an apparatus for melting an incineration residue containing salts, comprising:

a melting furnace which is charged with an incineration residue containing salts, and which contains a melt comprising molten salts, molten slag and molten metals;

a molten salt discharge port for discharging the molten salts, a molten slag discharge port for discharging the molten slag, and a molten metal discharge port for discharging the molten metals, which are provided in the melting furnace; and a heater for controlling the temperature of the vapor phase in the melting furnace.

Fourthly, the present invention provides a method for melting an incineration residue containing salts, comprising the steps of:

charging an incineration residue containing salts to a melting furnace containing a melt;

melting the incineration residue; and blowing a non-oxidizing gas into the vapor phase in the melting furnace to increase the amount of the exhaust gases exhausted from the melting furnace.

Fifthly, the present invention provides a method for melting an incineration residue containing salts, comprising the steps of:

charging an incineration residue containing salts to a melting furnace containing a melt;

melting the incineration residue; and supplying water to the vapor phase in the melting furnace and vaporizing the water to increase the amount of the exhaust gases exhausted from the melting furnace.

Sixthly, the present invention provides an apparatus for melting an incineration residue containing salts, comprising:

a melting furnace which contains a melt, and which is charged with an incineration residue containing salts; and a gas blowing pipe provided in the upper portion of the melting furnace, for blowing a gas into the vapor phase in the melting furnace.

Seventhly, the present invention provides an apparatus for melting an incineration residue containing salts, comprising:

a melting furnace which contains a melt, and which is charged with an incineration residue containing salts; and a water spray nozzle provided in the upper portion of the melting furnace, for spraying water into the vapor phase in the melting furnace.

BEST MODE FOR CARRYING OUT THE INVENTION

Best Mode 1

Figure 1:
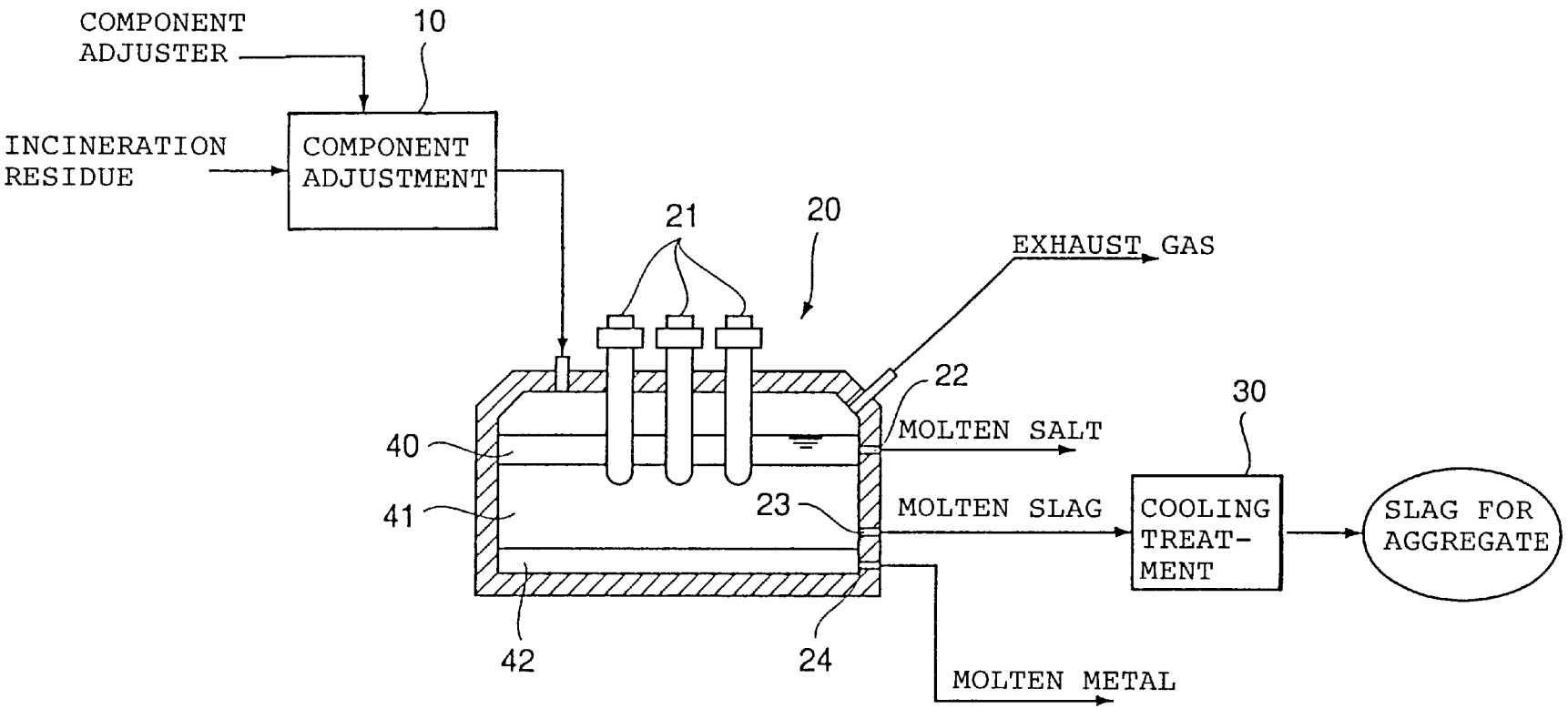
FIG. 1 is a schematic drawing showing a melting apparatus in accordance with best mode 1.

A method for melting an incineration residue containing salts in accordance with best mode 1 comprises the steps of:

adding a component adjustor to the incineration residue containing salts to adjust a component ratio in the range of 0.7 to 2.0;

charging the incineration residue having the adjusted component ratio to a melting furnace maintained in a reducing atmosphere, and melting the incineration residue to form a melt;

staying the melt in the melting furnace to separate the melt into a molten slag layer, a molten salt layer, and a molten metal layer;

fractionating the molten slag and discharging it; and rapidly cooling the discharged molten slag.

The component ratio is presented by a molar ratio as follows:

Component ratio (molar ratio)=(Ca+Mg)/(Si+Al) (1)

The step of rapidly cooling the molten slag is one selected from the following methods:

(a) the rapidly cooling method comprising bringing the molten slag into contact with water;

(b) the rapidly cooling method comprising bringing the molten slag into contact with a water-cooled metallic surface;

(c) the rapidly cooling method comprising supplying the molten slag on the periphery of a water cooled metallic drum; and (d) the rapidly cooling method comprising supplying the molten slag on the periphery of a water-cooled metallic roll.

As the component adjustor, a component adjustor containing Ca, a component adjustor containing Mg, a component adjustor containing Ca and Mg, a component adjustor containing Si, and a component adjustor containing Al, and a component adjustor containing Si and Al are used.

The component adjustor added for adjusting the component ratio of the incineration residue depends upon the composition of the incineration residue to be processed. In processing an incineration residue containing large amounts of Si and Al, such as general fly ash (neutral fly ash) collected in dust collection of the exhaust gases of a municipal waste incinerator, iron and steel slag, lime, or the like containing large amounts of Ca and Mg is added for component adjustment. In processing an incineration residue containing large amounts of alkali metals such as Ca, Mg, and the like, such as fly ash (alkali fly ash) collected in removal of hydrogen chloride by blowing slaked lime or the like into the duct of a municipal water incinerator, incineration ash of waste containing large amounts of Si and Al, coal ash, or the like is added.

In order to decrease the amount of chlorine eluted from the slag, the chlorine content of the slag may be decreased. However, in melting the incineration residue containing salts in-the reducing atmosphere, as described above, a large amount of chlorine is inevitably mixed in the slag. As a result of the test performed by the inventors, particularly, when the incineration residue containing Cl and large amounts of Ca, Mg, and the like, such as the fly ash (alkali ash) collected in removal of hydrogen chloride by blowing slaked lime or the like into the duct of the municipal water incinerator, is processed by the conventional method comprising melting the residue in the reducing atmosphere, and temporarily staying the melt in the furnace, a large amount of chlorine is mixed in the slag.

Accordingly, in order to elucidate the above-described phenomenon, the inventors studied the relation between the composition of the incineration residue and the chlorine content of slag or the elution amount of chlorine therefrom. As a result of study of the relation between the composition of the incineration residue and the chlorine content of slag, the results shown in FIG. 7 were obtained. In this test, the composition of the incineration residue was adjusted to obtain various values of the composition ratio represented by equation (1), and the molten slag obtained by melting the incineration residue was solidified so that the chlorine content of the slag was analyzed. The component ratio represented by equation (1) is the abundance ratio (molar ratio) of elements, which was determined from the analytic values of the incineration residue, and was used as an index indicating a property of the incineration residue.

Figure 7:
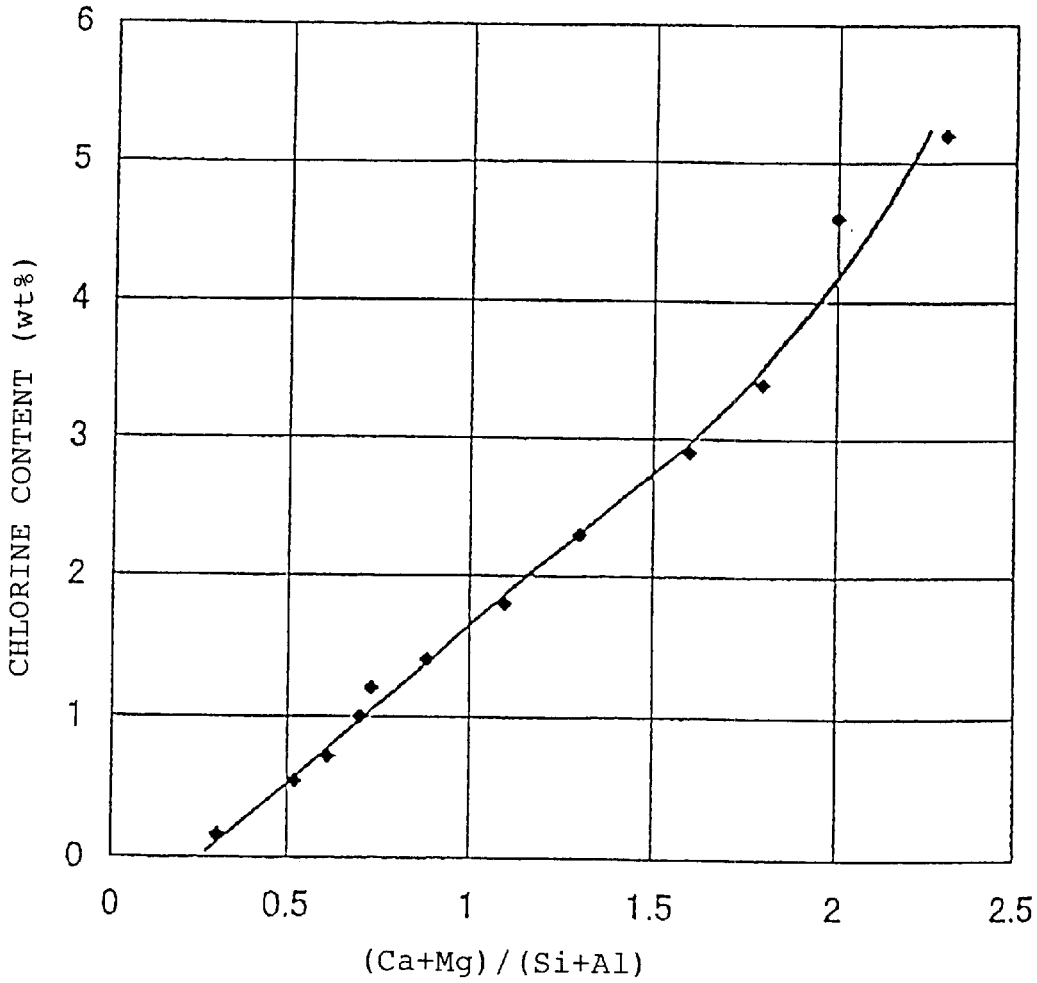
FIG. 7 is a diagram showing the relation between the component ratio and the chlorine content of slag in accordance with best mode 1.

FIG. 7 indicates that as the component ratio represented by (Ca+Mg)/(Si+Al) increases, the chlorine content of slag increases. This test was carried out when the molten slag was slowly cooled, and when the molten slag was rapidly cooled. However, no difference in the chlorine content was observed between the cooling methods. It was thus found that the molten slag obtained by melting the incineration residue having a composition with the high component ratio is in a state in which molten salts such as chlorides and the like easily dissolve, and that the chlorine content of the slag is determined by the composition of the incineration residue, and cannot be decreased.

Figure 8:
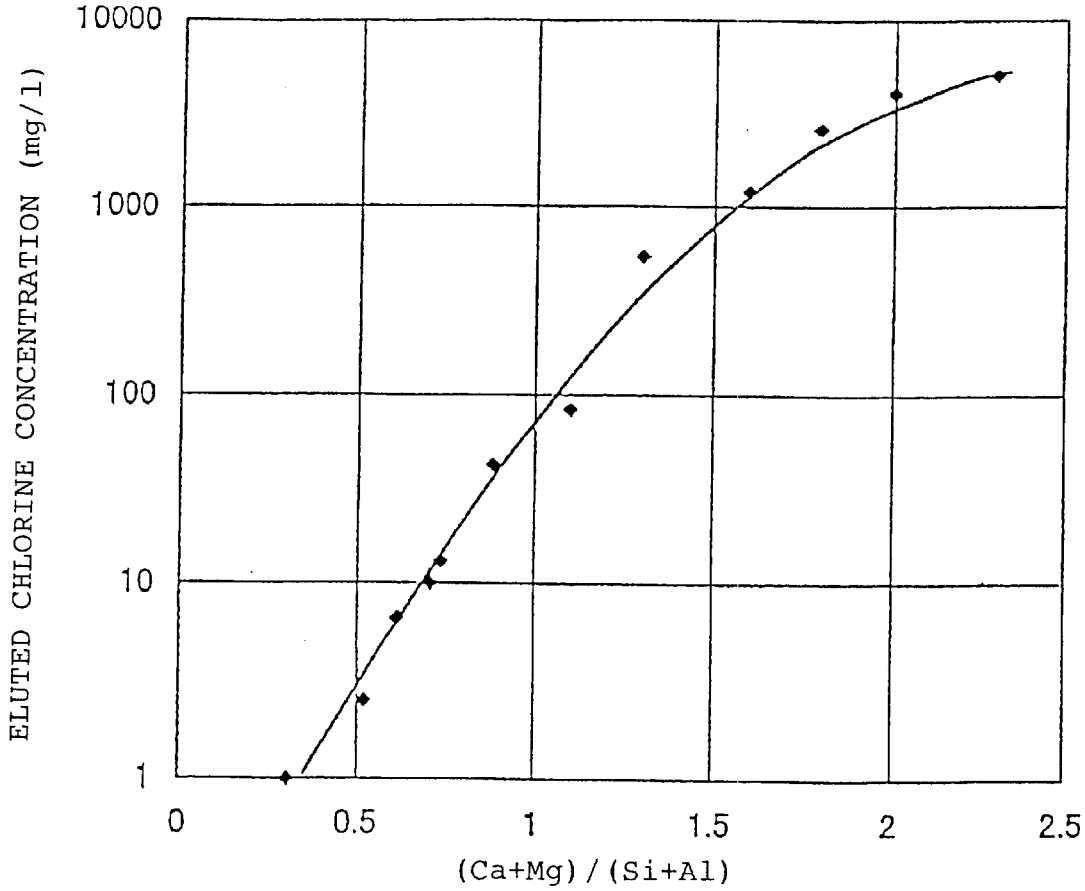
FIG. 8 is a diagram showing the relation between the component ratio and the concentration of eluted chlorine when molten slag was slowly cooled in accordance with best mode 1.

Next, after each of the incineration residues having various component ratios represented by (Ca+Mg)/(Si+Al) was adjusted, the molten slag obtained by melting was allowed to stand for cooling, and the resultant solid slag was ground. As a result of an elution test, a large amount of chlorine was eluted from all types of slag. The results are shown in FIG. 8. FIG. 8 indicates that when the molten slag is allowed to stand for cooling, in order to obtain slag showing a chlorine elution concentration of 10 mg/l or less, which is the industrial requirement value of cement quality, the composition of the incineration residue must be adjusted so that the component ratio represented by (Ca+Mg)/(Si+Al) is about 0.7 or less. Therefore, the compositions of incineration residues which can be processed are restricted to a narrow range of compositions.

The cause of this is possibly that in cooling the molten slag to form solid slag, slow cooling such as standing to cool causes precipitation of slats such as sodium chloride, potassium chloride, calcium chloride, and the like. The precipitates of salts are possibly present not only on the surfaces of slag blocks, but also in cracks and voids in the slag, and thus the salts are eluted by grinding the slag.

Therefore, in the present invention, elution of chlorine is suppressed. Namely, after the composition of the incineration residue is adjusted according to the equation (1), the incineration residue is melted, and the resultant molten slag is rapidly cooled to produce an amorphous phase, thereby obtaining slag in which elution of chlorine is suppressed.

Figure 9:
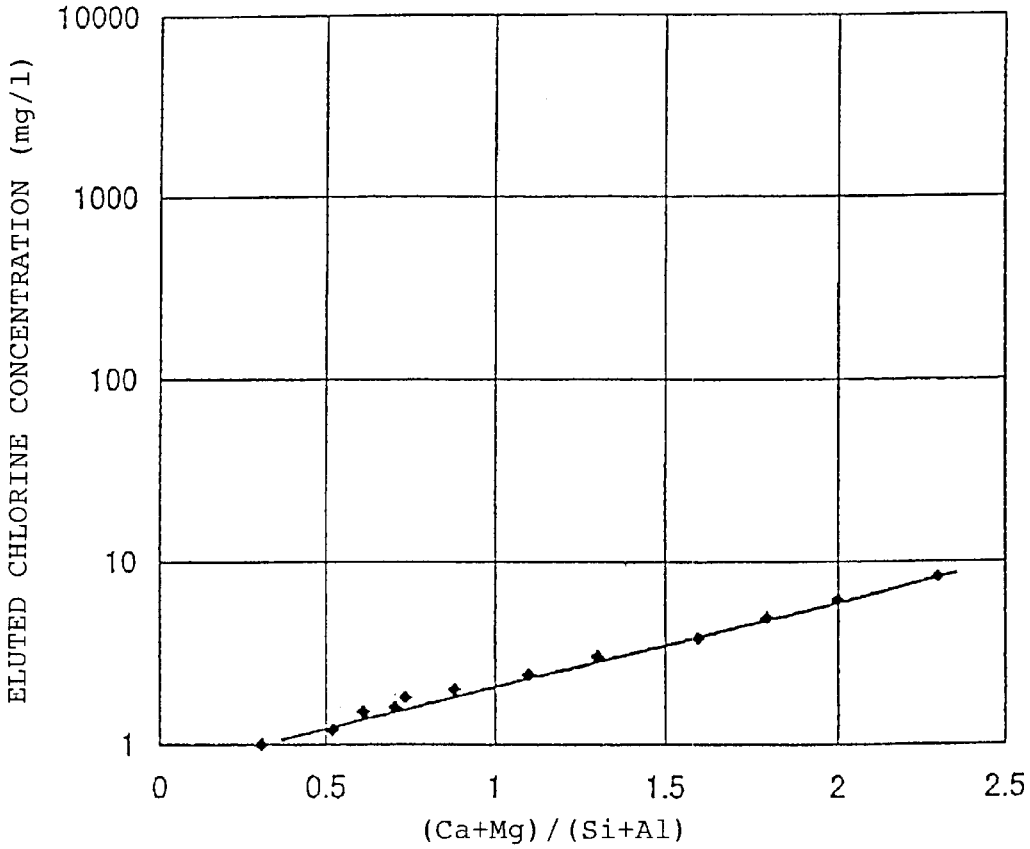
FIG. 9 is a diagram showing the relation between the component ratio and the concentration of eluted chlorine when molted slag was rapidly cooled in accordance with best mode 1.

Therefore, the inventors carried out a test in which each of incineration residues having component ratios represented by (Ca+Mg)/(Si+Al) and adjusted to various values was melted, the resultant molten slag was rapidly cooled. In this test, the rapidly cooled slag was ground, and then subjected to an elution test according to the method of deciding soil environment standards (Notification No. 46 of Environment Agency). As a result, as shown in FIG. 9, the chlorine elution concentrations of all types of slag were lower than 10 mg/l which was the industrial requirement value of cement quality. Also, X ray diffraction of the slag indicated that the slag was amorphous or contained an amorphous phase. As a result of observation of the slag on a scanning analytical electron microscope, chlorine was uniformly distributed in an amorphous texture (glass texture), and no precipitate of chloride was observed.

The results of each of the tests reveal that in the process of solidifying the molten slag present with chlorine molten, slow cooling causes chlorine (Cl) to move in the molten slag and combine with Na, K, Ca, etc. to form compounds such as NaCl, KCl, CaCl, etc., which are possibly precipitated. However, rapidly cooling the molten slag causes solidification before chlorine is moved, thereby uniformly fixing chlorine in the atomic level in the amorphous texture. Therefore, even when the slag is either ground or leached with water, the chlorine elution amount is suppressed to a low level.

The results shown in FIG. 9 indicate that by adjusting the incineration residue so that the component ratio represented by (Ca+Mg)/(Si+Al) is 0.3 to 2.3, the chlorine elution concentration is a value lower than 10 mg/l. However, in an actual operation of the melting furnace, the fluidity of the melt in the furnace must be controlled to a state required for operating the furnace, and the melting temperature is desired to be as low as possible. In consideration of these operational problems, in order to secure the fluidity of the molten slag, it is necessary to adjust the component ratio represented by (Ca+Mg)/(Si+Al) to be larger than about 0.7, and in order that the melting temperature is not excessively higher than that in a usual operation, the component ratio must be adjusted to about 2.0 or less. Therefore, the component ratio represented by (Ca+Mg)/(Si+Al) is preferably 0.7 to 2.0.

In addition, with the melt having appropriate fluidity, as described above, an operation readily forms three layers including a molten salt layer, a molten slag layer, and a molten metal layer in the furnace. The operation is performed to separately discharge the separate three layers of the melt, preventing contamination of the molten slag with metals.

FIG. 1 is a drawing showing an embodiment of the present invention. In this embodiment, an incineration residue containing salts is sent to a component adjustment step 10 in which for example, incineration ash, coal ash, quartzite, or iron and steel slag produced in iron works, lime, or the like is added to adjust the component ratio represented by equation (1) to a predetermined value in the range of 0.7 to 2.0. The incineration residue containing the adjusted components is charged to, for example, an electric resistance melting furnace 20. In this melting furnace 20, the melt of the incineration residue previously melted stays, and electrodes 21 are immersed in the melt. Electricity is supplied to the melt to generate electric resistance heat for heating the melt. The incineration residue charged to the furnace is heated to be melted by heat transmitted from the melt. The melt is stayed in the furnace for about 10 to 20 hours, and then discharged. During this time, salt, oxide, and metal components are separated by differences in specific gravity to form three layers including a molted salt layer 40, a molten slag layer 41, and a molten metal layer 42 in the furnace. The three separated layers respectively comprising the components are separately discharged. The molten salts are discharged from a molten salt discharge port 22, and the molten metals are discharged from a metal discharge port 24, followed by waste disposal or recovery as resources.

Of the separately discharged components, the molten slag is sent to a cooling step 30. In this step, the molten slag is rapidly cooled to a transition temperature (about 700 to 800° C.) at which the slag is made amorphous. As the processing method, a method of pouring the molten slag into a water bath or flowing water to bring the molten slag into directly contact with water is used for efficiently rapidly cooling the molten slag. Alternatively, the molten slag may be rapidly cooled by a method of blowing the molten slat together with high-pressure air.

The molten slag may be rapidly cooled by indirect cooling. In the case of indirect cooling, the molten slag may be cooled by discharging the molten slag into a water-cooled metallic mold or metallic louder to bring it into contact with the water-cooled metallic surface.

Figure 2:
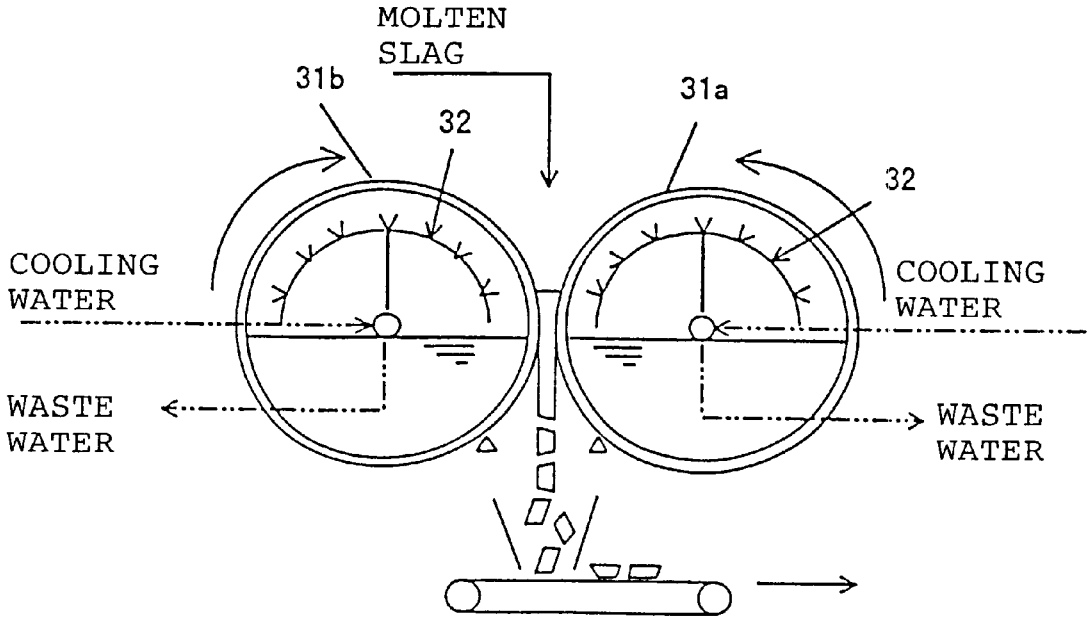
FIG. 2 is a schematic drawing showing an apparatus for cooling and solidifying molten slag comprising two water cooling drums in accordance with best mode 1.
Figure 3:
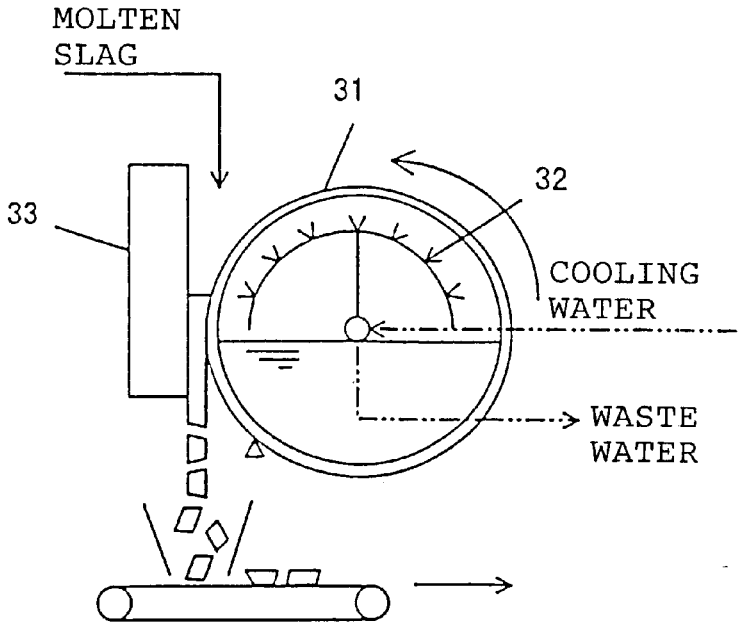
FIG. 3 is a schematic drawing showing an apparatus for cooling and solidifying molten slag comprising a water cooling drum in accordance with best mode 1.
Figure 4:
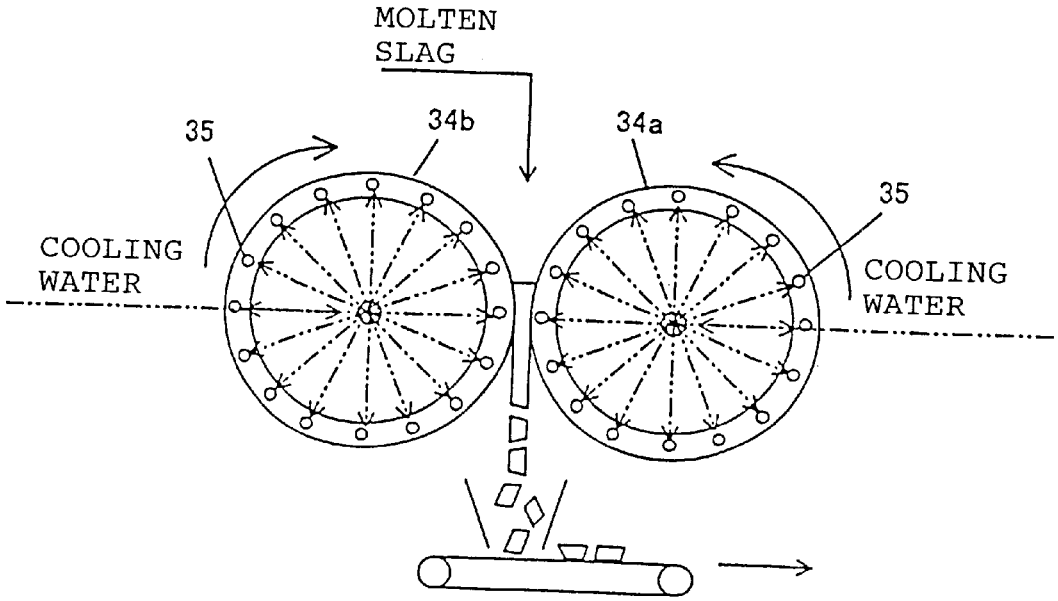
FIG. 4 is a schematic drawing showing an apparatus for cooling and solidifying molten slag comprising two water cooling rolls in accordance with best mode 1.
Figure 5:
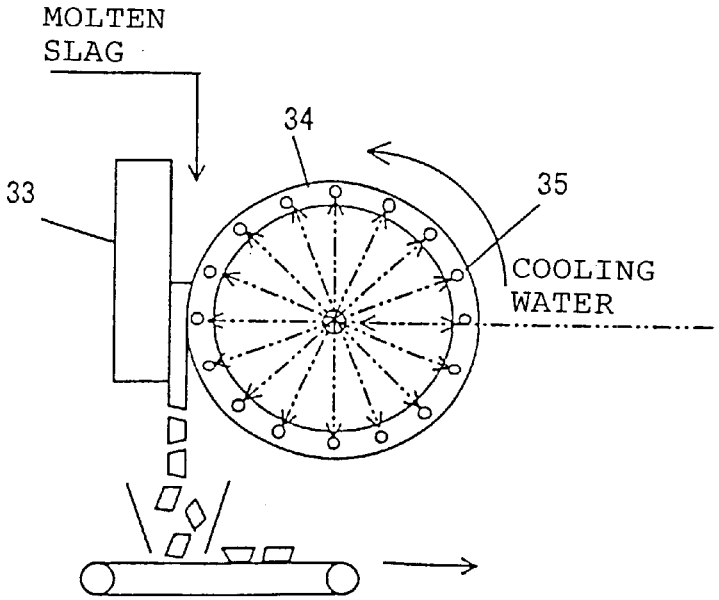
FIG. 5 is a schematic drawing showing an apparatus for cooling and solidifying molten slag comprising a water cooling roll in accordance with best mode 1.
Figure 6:
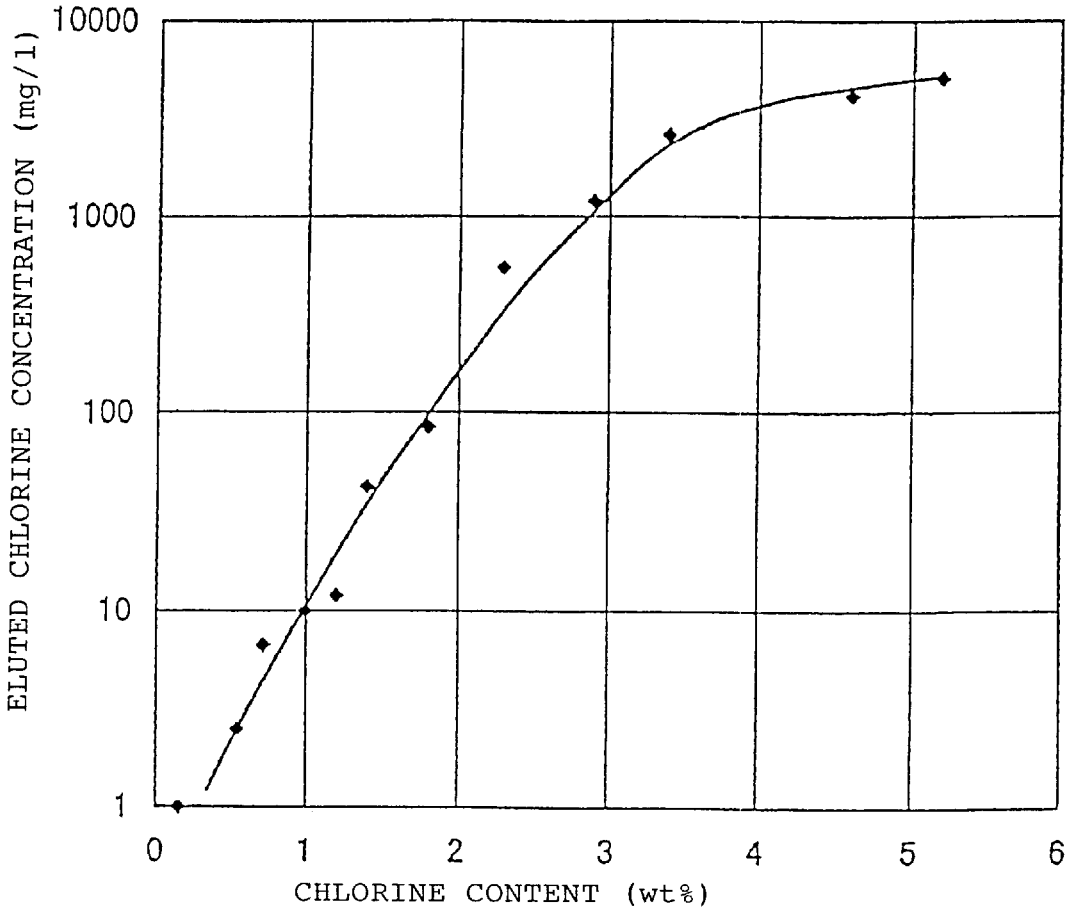
FIG. 6 is a diagram showing the relation between the chlorine content of slag and the concentration of eluted chlorine in accordance with best mode 1.

Another method can also be used for rapidly cooling the molten slag, which uses, for example, a cooling solidification apparatus comprising such a water-cooled drum as shown in FIG. 2 or 3, or a cooling solidification apparatus comprising such a water-cooled roll as shown in FIG. 4 or 5.

FIG. 2 shows an apparatus for cooling and solidifying the molten slag, comprising two water-cooled drums. In this apparatus, the molten slag is rapidly cooled by bringing it into contact with a pair of water-cooled drums 31*a* and 31*b* whose peripheries are opposite to each other, and in each of which a cooling water spray nozzle 32 is provided so that the water-cooled drum is cooled by cooling water sprayed to the inner surface-thereof. The cooling rate of the molten slag is adjusted by appropriately controlling the flow rate of the cooling water and the rotational speed of the water-cooled drums. In rapidly cooling the molten slag to solidifying it by the apparatus, the molten slag is supplied onto the rotating water-cooled drums 31*a* and 31*b* with the distance therebetween controlled to a predetermined value. The solidified slag falls as flat blocks.

In the use of the apparatus, the cooling time is significantly decreased, and miniaturization of the apparatus is achieved, as compared with a case in which the molten slag is cooled by pouring into a mold. Since the solidified slag has a block shape having a substantially uniform thickness, in crushing the blocks to obtain a predetermined particle size, loads of crushing and subsequent particle size control are significantly decreased, and the crushed particles have a narrow particle size distribution, and are obtained with a predetermined particle size in high yield. With the drums having uneven surfaces, since the slag formed in an appropriate size can be obtained, loads of crushing and subsequent particle size control are further decreased, and the slag having less angles can be obtained with a low degree of crushing.

FIG. 3 shows a cooling and solidification apparatus for molten slag, comprising a water-cooled drum. This apparatus comprises a water-cooled drum 31 having the same structure as the apparatus shown in FIG. 2, and a water-cooled wall 33 provided opposite to the periphery of the water-cooled drum 31. In rapidly cooling the molten slag to solidify it by this apparatus, the molten slag is supplied between the rotating water-cooled drum 31 and the water-cooled wall 33, with the distance therebetween adjusted to a predetermined value. The solidified slag falls as flat blocks.

FIG. 4 shows an apparatus for cooling and solidifying the molten slag, comprising two water-cooled rolls. In this apparatus, the molten slag is rapidly cooled by bringing it into contact with a pair of water-cooled rolls 34*a* and 34*b* whose peripheries are opposite to each other, and in each of which a cooling water flow passage 32 is provided in the outer shell, which forms the outer periphery, so that the water-cooled drum is cooled. The cooling rate of the molten slag is adjusted by appropriately controlling the flow rate of the cooling water and the rotational speed of the water-cooled rolls. In rapidly cooling the molten slag to solidifying it by the apparatus, the molten slag is supplied onto the rotating water-cooled rolls 34*a* and 34*b* with the distance therebetween controlled to a predetermined value. The solidified slag falls as flat blocks.

The use of this apparatus produces the same effect as the use of the apparatus comprising the water-cooled drum shown in FIG. 2 or 3, can make use of the advantage that heat recovery is possible. Namely, since the cooling water passed through the flow passages 35 provided in the water-cooled rolls is discharged to the outside, the cooling waste water of high temperature is sometimes discharged, thereby permitting recovery of heat.

FIG. 5 shows a cooling and solidification apparatus for molten slag, comprising a water-cooled roll. This apparatus comprises a water-cooled roll 34 having the same structure as the apparatus shown in FIG. 4, and a water-cooled wall 33 provided opposite to the water-cooled roll 34. In rapidly cooling the molten slag to solidify it by this apparatus, the molten slag is supplied between the rotating water-cooled drum 34 and the water-cooled wall 33, with the distance therebetween adjusted to a predetermined value. The solidified slag falls as flat blocks.

By the above-mentioned indirect cooling, block slag is obtained. Therefore, the slag can be used in applications unlike sandy slag obtained by direct cooling, for example, such as alternative material for crushed stone, and the like. Particularly, flat block slag has a narrow particle size distribution after crushing, and can also be used as aggregate for water absorption and sound absorption pavement.

The slag obtained as described above exhibits a low chlorine elution amount, and can be applied to use as aggregate for civil engineering and construction.

The results of melting incineration residues containing salts will be described below.

EXAMPLE 1

The fly ash collected by blowing slaked lime or the like into the duct of a municipal waste incinerator to remove hydrogen chloride is mixed with incineration ash (the analytical values are shown in Table 1) at a ratio of 1:2 to obtain an incineration residue (the analytical values are shown in Table 2) containing components adjusted so that the component ratio represented by equation (1) is about 0.8. The thus-obtained incineration residue was charged to an experimental furnace and melted to form molten slag which was then fractionated and discharged. At this time, the molten slag was poured into a water bath to be rapidly cooled. The analytical values of the rapidly cooled slag after dying were as shown in Table 3, and the chlorine content was 1.5%.

The slag was crushed into a size of 2 mm or less, and the resultant sample was subjected to the elution test according to the method of deciding soil environment standards (Notification No. 46 of Environment Agency). In this elution test, the slag was crushed into a size of less than 2 mm, and a 10-fold amount of purified water was added to the crushed slag, followed by shaking for 6 hours. After filtration separation, the chlorine concentration of the eluate was analyzed. The results of the elution test are shown in Table 4. As shown in this table, the concentration of chlorine eluted from the slag is a satisfactory value of 2 mg/l.

Although the slag was not subjected to magnetic separation, no iron particle was observed. This indicates that in discharge of the molten slag, the molten metals are sufficiently separated.

EXAMPLE 2

The same fly ash as Example 1 was mixed with incineration ash at a ratio of 1:1 to obtain an incineration residue (the analytical values are shown in Table 2) containing components adjusted so that the component ratio represented by equation (1) was about 1.1. The thus-obtained incineration residue was melted to form molten slag, which was then rapidly cooled by pouring into a water bath by the same method as Example 1. Although the obtained slag contained 2.3% of chlorine, as shown in Table 3, the concentration of chlorine eluted was a satisfactory value of 3 mg/l, as shown in Table 4.

EXAMPLE 3

An incineration residue containing components adjusted by the same method as Example 2 was melted, and the resultant molten slag was rapidly cooled by pouring into a steel plate louder having a water-cooled structure to obtain a slag plate having a thickness of about 2 cm. Although the obtained slag contained 2.4% of chlorine, as shown in Table 3, the concentration of chlorine eluted was a satisfactory value of 4 mg/l, as shown in Table 4, like in Examples 1 and 2.

EXAMPLE 4

The same fly ash as Example 1 was mixed with incineration ash at a ratio of 1:1 to obtain an incineration residue (the analytical values are shown in Table 2) containing components adjusted so that the component ratio represented by equation (1) was about 1.0. The thus-obtained incineration residue was melted to form molten slag, which was then rapidly cooled by using water-cooled drums having the same structure as shown in FIG. 2. In this case, the molten slag was flowed on the water-cooled drums with the distance therebetween adjusted to 2 cm, and the cooled and solidified slag was scraped off. The scraped slag was a flat block having a thickness of about 2 cm. Next, the slag was crushed by a jaw crusher to obtain slag having a particle size of about 2 cm. Table 3 shows the analytical values of the slag, and Table 4 shows the concentration of chlorine eluted. Tables 3 and 4 indicate that the slag contains 1.8% of chlorine, but the concentration of chlorine eluted is a satisfactory value of 3 mg/l, like in Examples 1 to 3.

COMPARATIVE EXAMPLE 1

An incineration residue containing components adjusted by the same method as Example 2 was melted, and the resultant molten slag was spontaneously cooled by pouring into a cast iron mold and allowing to stand. The analytical values of this slag were as shown in Table 3, and the chlorine content was 2.4%.

The slag was subjected to the same elution test as Example 1. Table 4 shows the results. This table indicates that the concentration of chlorine eluted from the slag is 510 mg/l, which greatly exceeds 10 mg/l as the industrial requirement value of cement quality.

TABLE 1

(wt %)

| | Fly ash | Incineration ash |
|---|---|---|
| Ca | 44.7 | 14.9 |
| Mg | 0.98 | 1.5 |
| Si | 5.1 | 22.4 |
| Al | 2.4 | 9.0 |
| Cl | 19.0 | 0.78 |
| (Ca + Mg)/(Si + Al) (molar ratio) | 4.26 | 0.38 |

TABLE 2

| | Example 1 | Example 2 | Example 3 | Example 4 | (wt %) Comp. Example |
|---|---|---|---|---|---|
| Ca | 24.8 | 29.8 | 29.8 | 27.5 | 29.8 |
| Mg | 1.3 | 1.2 | 1.2 | 1.3 | 1.2 |
| Si | 16.6 | 13.8 | 13.8 | 14.9 | 13.8 |
| Al | 6.8 | 5.7 | 5.7 | 6.2 | 5.7 |
| Cl | 6.9 | 9.9 | 9.9 | 10.7 | 9.9 |
| (Ca + Mg)/(Si + Al) (molar ratio) | 0.80 | 1.13 | 1.13 | 0.97 | 1.13 |

TABLE 3

| | Example 1 | Example 2 | Example 3 | Example 4 | (wt %) Comp. Example |
|---|---|---|---|---|---|
| Ca | 21.4 | 26.2 | 25.8 | 23.7 | 26.0 |
| Mg | 1.4 | 1.3 | 1.2 | 1.3 | 1.4 |
| Si | 16.8 | 14.0 | 14.1 | 15.1 | 14.0 |
| Al | 6.9 | 5.8 | 5.6 | 6.3 | 5.7 |
| Cl | 1.5 | 2.3 | 2.4 | 1.8 | 2.4 |
| (Ca + Mg)/(Si + Al) (molar ratio) | 0.70 | 0.99 | 0.98 | 0.84 | 1.00 |

TABLE 4

| | Cl |
|---|---|
| Example 1 | 2 mg/l |
| Example 2 | 3 mg/l |
| Example 3 | 4 mg/l |
| Example 4 | 3 mg/l |
| Comparative Example | 510 mg/l |

Best Mode 2

A method for melting an incineration residue containing salts in accordance with best mode 2 comprises the steps of:

charging an incineration residue containing salts to a melting furnace containing a melt;

melting the incineration residue; and maintaining the temperature of the vapor phase in the melting furnace at 700 to 1000° C.

The step of maintaining the temperature of the vapor phase preferably comprises heating the vapor phase in the melting furnace to maintain the temperature of the vapor phase at 700 to 1000° C.

An apparatus for melting an incineration residue containing salts in accordance with best mode 2 comprises:

a melting furnace which is charged with the incineration residue containing salts, and which contains a melt comprising molten salts, molten slag and molten metals;

a molten salt discharge port for discharging the molten salts, a molten slag discharge port for discharging the molten slag, and a molten metal discharge port for discharging the molten metals, which are provided in the melting furnace; and a heater for controlling the temperature of the vapor phase in the melting furnace.

The melting furnace preferably comprises a melting portion and a molten salt discharge portion, which are communicated with each other through the vapor phase portion, wherein the incineration residue is charged to the melting portion and melted, and the melt is stayed to separate components, and the molten salts flowing from the melting portion are received by the molten salt discharge portion and then discharged.

The melting apparatus preferably comprises a molten salt discharging submerged weir which is formed in the upper portion of the side where the molten salt discharge port is provided, and which has the lower end at a position lower than a height corresponding to the hot water level in formation of a molten salt layer, and the upper portion having an opening.

In an operation of the melting furnace into which the incineration residue is charged and melted with the melt stayed in the furnace, the molten salts are present on the high-temperature molten slag, and thus vaporization of low-boiling-point substances such as alkali metal salts, heavy metals, etc. cannot be inhibited. However, the inventors studied various methods of suppressing the occurrence of dust due to vaporization of alkali metal salts. As a result, the inventors found a method in which vaporized alkali metal salts and heavy metal salts are separated in the furnace so that the heavy metal salts can be discharged to the outside of the furnace together with exhaust gases, while the alkali metal salts are stayed in the furnace.

In this study, in consideration of the fact that the alkali metal salts and heavy metal slats have differences in vapor pressure characteristics, the vapor pressures of both types of salts were examined. In accordance with the table described in the chemical procedure manual, the vapor pressures of both salts are briefly described as follows. Alkali metal salts NaCl and KCl have substantially same vapor pressure properties in which vapor pressure increases at a temperature of over about 1000° C. On the other hand, heavy metals such as zinc, lead, cadmium, and the like are present in the forms of $ZnCl_2$, PbCl, $CdCl_2$, and the like, which compounds produce vapor pressure of over 760 mmHg in the temperature region of 1000° C. or less. Therefore, the heavy metal salts vaporize in the temperature region lower than the vaporization temperatures of the alkali metal salts. Particularly, of the heavy metal salts in dust discharged together with exhaust gases, $ZnCl_2$ having a highest content has a vapor pressure of 760 mmHg at about 700° C., and thus vaporizes in a temperature region lower than the vaporization start temperature of alkali metal salts.

Therefore, since the alkali metal salts and the heavy metal salts have the above-described differences in vapor pressure properties, in consideration of the state where a mixture of alkali metal salts and heavy metal salts is gradually heated, the heavy metal salts first vaporize, leaving the alkali metal salts in a solid or liquid state. Next, conversely, supposing a state where a vapor mixture of alkali metal salts and heavy metal salts is gradually cooled, the alkali metal salts are first condensed, leaving the heavy metal salts in a gaseous state.

Therefore, when the vapor phase in the melting furnace is maintained at a temperature region higher than the vaporization temperature of heavy metal salts, which cause no vaporization of alkali metal salts, of the vapors of the molten salts, vapors of the heavy metal slats are discharged together with exhaust gases, and condensed and solidified in the outside of the furnace to form dust. On the other hand, vapors of the alkali metal salts are condensed in the furnace to form particles of the molten salts. During the time the particles stay in the furnace, the particles are grown by aggregation and fall. The deposited molten salts are discharged.

In order to discharge the heavy metal salts together with exhaust gases while condensing the alkali metal salts, as described above, it is necessary to maintain the temperature of the vapor phase in the furnace in the range of 700 to 1000° C. The lower limit of 700° C. of this temperature range is a temperature at which the heavy metal salts, particularly $ZnCl_2$ contained in the dust at the highest content, is maintained in a gaseous state, and the alkali metal salts (a mixture of a plurality of salts such as NaCl, KCl, etc.) is not solidified. The upper limit of 1000° C. is a temperature at which the alkali metal salts are present in a melt state.

Although the lower temperature limit of the vapor phase in the furnace is 700° C., this temperature is in a temperature region where the alkali metal salts (NaCl, KCl) in the incineration residue are present in a melt state. Although the melting points of NaCl and KCl is in the range of 750 to 800° C., a mixture of these salts is decreased to a range of 700° C. or less, and thus the molten salts produced by melting the incineration residue containing a plurality of salts are not solidified at 700° C.

When the temperature of the vapor phase in the furnace is maintained at 700 to 1000° C., a heater is provided in the vapor phase in the furnace so that the temperature of the vapor phase can be maintained in an appropriate range by heating. In an operation of the melting furnace to which the incineration residue is charged with the melt stayed in the furnace, as described above, the melt in the furnace is covered with the unmelted incineration residue which functions as a thermal insulating layer to prevent heat transfer from the high-temperature melt to the vapor phase. Therefore, by changing the thickness of the incineration residue, the vapor phase can be maintained at an appropriate temperature.

Figure 10:
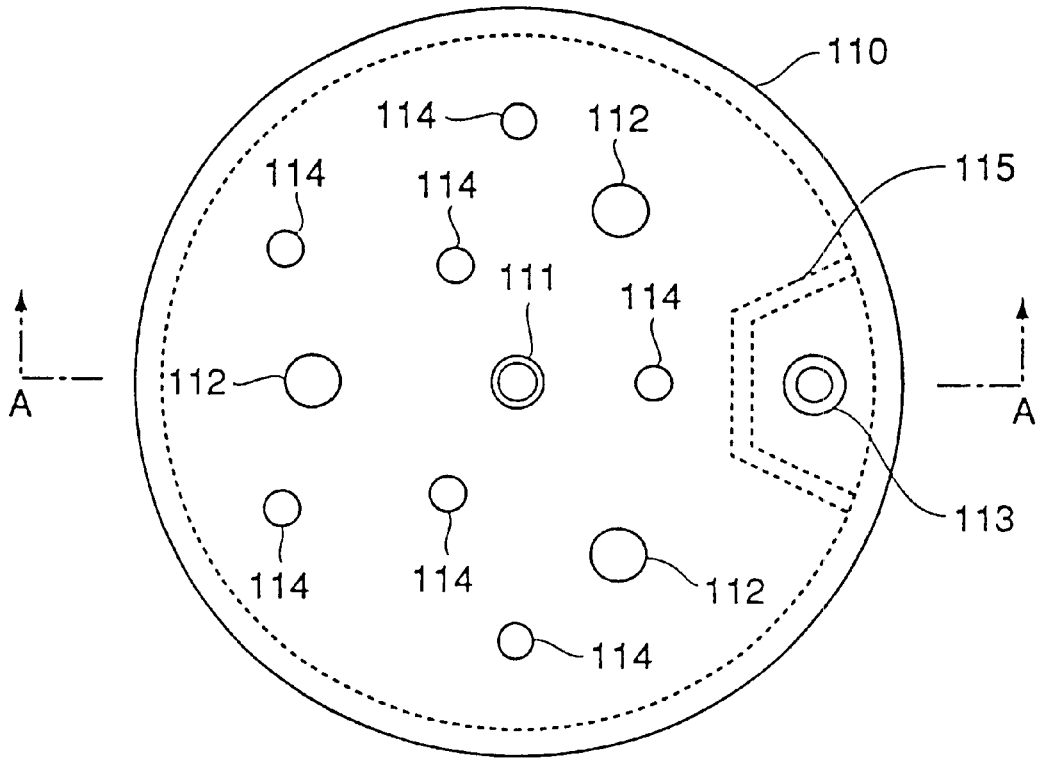
FIG. 10 is a plan view of a melting furnace in accordance with best mode 2.
Figure 11:
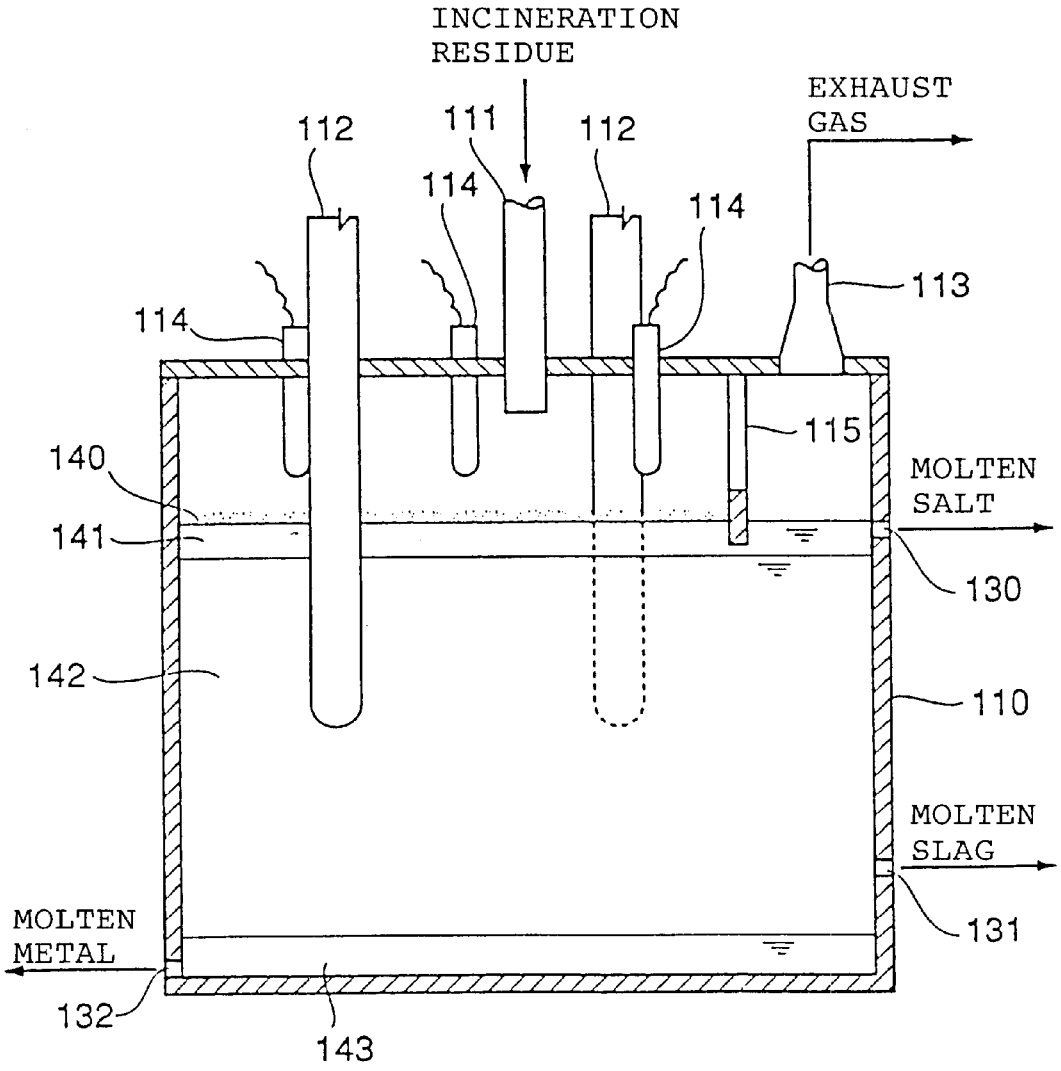
FIG. 11 is a sectional view taken along line A—A in FIG. 10.

FIG. 10 is a plan view showing a melting furnace in accordance with an embodiment of the present invention, and FIG. 11 is a sectional view taken along line A—A in FIG. 10. The melting furnace shown in FIGS. 10 and 11 is an electric resistance type, in which reference numeral 110 denotes a body of the melting furnace; reference numeral 141, a molten salt layer; reference numeral 142, a molten slag layer; reference numeral 143, a molten metal layer; reference numeral 140 an incineration residue charged to cover a melt. In FIGS. 10 and 11, reference numeral 111 denotes an inlet pipe of the incineration residue; reference numeral 112, an electrode immersed into the melt, for generating electric resistance heat; reference numeral 113, a gas exhaust pipe; reference numeral 114, a heater for heating the vapor phase in the furnace; reference numeral 115, a molten salt discharging submerged weir. Reference numeral 130 denotes a molten salt discharge port; reference numeral 131, a molten slag discharge port; reference numeral 132, a molten metal discharge port. The submerged weir 115 is adapted for inhibiting mixing of the incineration residue during discharge of the molten salts, and provided in the upper portion of the furnace body on the side where the molten salt discharge port 130 is provided, so as to surround the inside of the molten salt discharge port 130. The lower end of the submerged weir 115 is at a position lower than the height corresponding to the hot water level in formation of the molten salt, and higher than the upper surface level in formation of the molten slag layer. The upper portion of the submerged weir 115 is open so as not to partition the vapor phase portion in the furnace body 110.

The operation of melting the incineration residue containing salts by the melting furnace having the above-described construction is carried out as follows:

The incineration residue is charged to the furnace in which the melt heated by supplying electricity between the electrodes 112 is stayed, and melted therein. The incineration residue is charged to the furnace through the incineration residue inlet pipe 111 to assume a state in which the melt is covered with the incineration residue. The incineration residue 140 which covers the melt is successively melted in the lower portion thereof by pre-heating due to the heat transmitted from the melt. In melting the incineration residue, the components are divided into molten salts, molted slag and molten metals by differences in specific gravity to form three layers including the molten salt layer 141, the molten slag layer 142 and the molten metal layer 143 in the furnace. The molten salt, the molten slag, and the molten metals are continuously or intermittently discharged through the molten salt discharge port 130, the molten slag discharge port 131, and the molten metal discharge port 132, respectively. Exhaust gases are discharged through the gas exhaust pipe 113, and sent to an exhaust gas processing apparatus.

In melting the incineration residue, the molten salts present on the molten slag layer 142 are heated by the high-temperature molten slag, and the molten salts are much vaporized, and transferred to the vapor phase. However, the gases produced in melting are produced by decomposition of small amounts of unburned substances contained in the incineration residue and vaporization of water, and thus the amounts of the gases produced are very small. Therefore, in melting the incineration residue collected by a dry method in incineration of waste, gases are produced in amounts of only about 50 to 100 $Nm^3$ per ton of incineration residue. Thus, the gases produced are moved toward the gas exhaust pipe 113 at a very low speed.

In this state, since the vapor phase is heated by the heater 114 to be maintained at the set temperature of 700 to 1000° C., heavy metal salts of the vaporized molted salts are discharged in a gaseous state to the outside of the furnace together with the exhaust gases. However, alkali metal salts are condensed to form particles of the molten salts, and grow due to aggregation with salts which are newly condensed during stay in the furnace, and fall. The deposited alkali metal salts are returned to the molten salt layer 141, and discharged through the molten salt discharge port 130.

Figure 12:
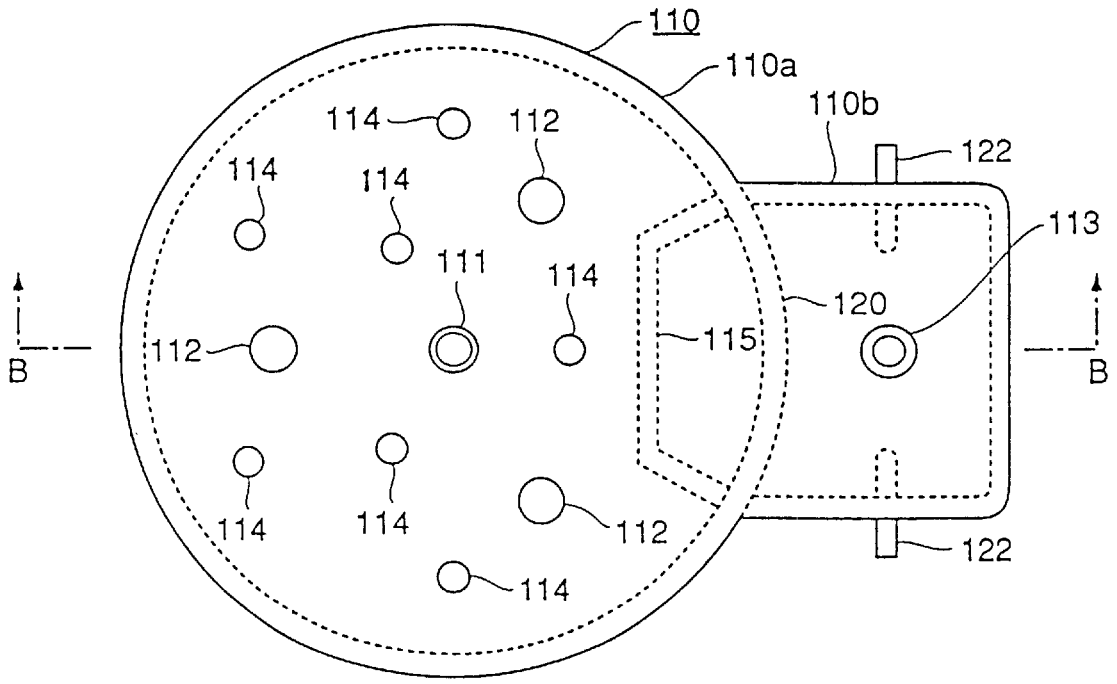
FIG. 12 is a plan view of another melting furnace in accordance with best mode 2.
Figure 13:
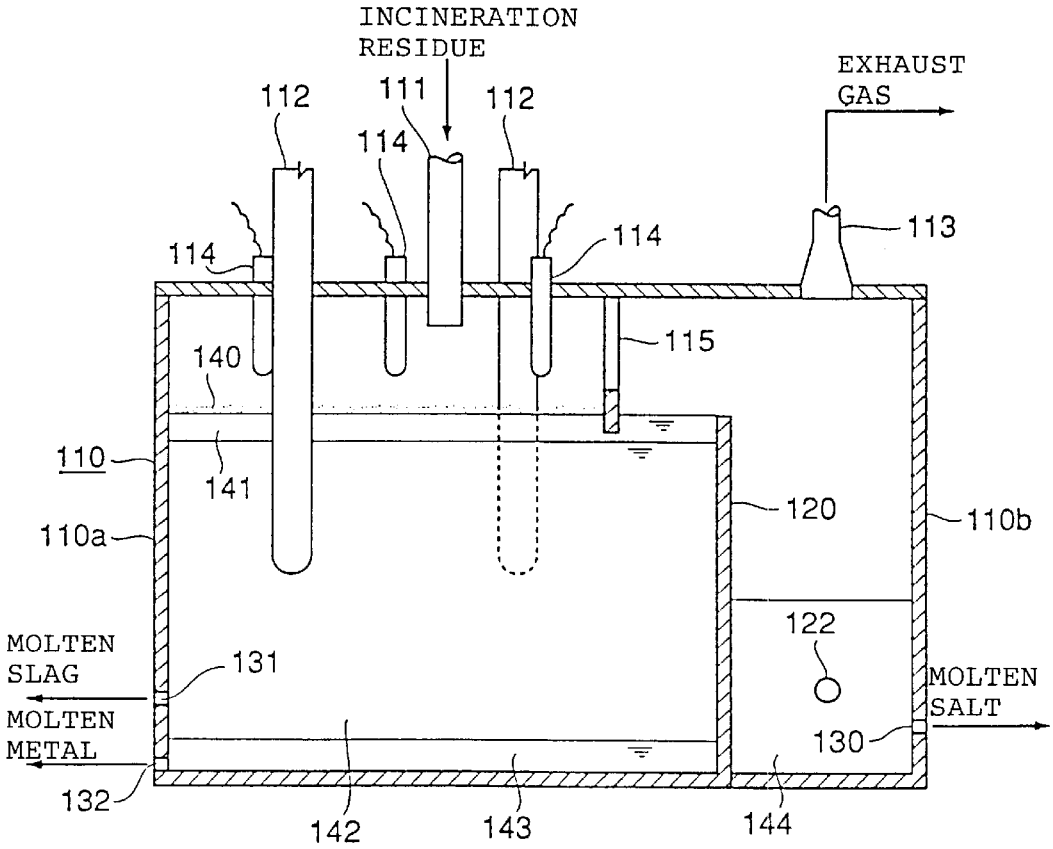
FIG. 13 is a sectional view taken along line A—A in FIG. 12.

FIG. 12 is a plan view showing a melting furnace in accordance with another embodiment of the present invention, and FIG. 13 is a sectional view taken along line B—B in FIG. 12. In FIGS. 12 and 13, the same portions as FIGS. 10 and 12 are denoted by the same reference numerals, and description there of is omitted. In this embodiment, an overhanging portion is provided on the furnace body 110, both of which are communicated with each other through the vapor phase portion. The furnace body 110 is partitioned by an overflow weir 120 having an upper end positioned at a height corresponding to the upper surface level of the melt stayed in the furnace to form two portions including a melting portion 110*a* into which the incineration is charged and melted, and the resultant melt is stayed to be separated into three layers including the molted salt layer 141, the molten slag layer 142 and the molten metal layer 143, and a molten salt discharge portion 110*b* in which the molted salts overflowing from the melting portion 110*a* are received and discharged. The molten salt discharge portion 110*b* also comprises the gas exhaust pipe 113. In the melting furnace having the above construction, the molten salts in the melting portion 110*a* overflow and are collected in the molten salt discharge portion 110*b*, and then discharged through the molten salt discharge port 130.

By providing the molten salt discharge portion 110*b*, the volume of the vapor phase is increased, and a long time is required for the produced gases to reach the gas exhaust pipe 113 from the melting portion 110 since the gas exhaust pipe 113 is provided on the molten salt discharge portion 110*b*, thereby increasing the residence time of molten salt particles in the furnace. As a result, aggregation of alkali metal salts further proceeds to further increase the size of the molten salt particles, facilitating deposition of the particles. Consequently, the amounts of the alkali metal salts discharged to the outside of the furnace together with the exhaust gases are further decreased.

The heavy metal salts in the molten salts produced in the melting portion 110*a* are not all vaporized and disappear, but partially remain in the molten salts, and overflow into the molten salt discharge portion 110*b*. Therefore, a heater 122 is provided on the molten salt discharge portion 110*b* so as to pass through the side wall thereof, so that the molten salts 44 accumulated in the molten salt discharge portion 110*b* can be heated. This heating permits the molten salts 144 to be maintained in a state where they are not solidified by maintaining the temperature thereof at 700 to 1000° C., and the heavy metal salts in the molten salts to be vaporized to further decrease the contents of the heavy metals in the molten salts discharged.

Figure 14:
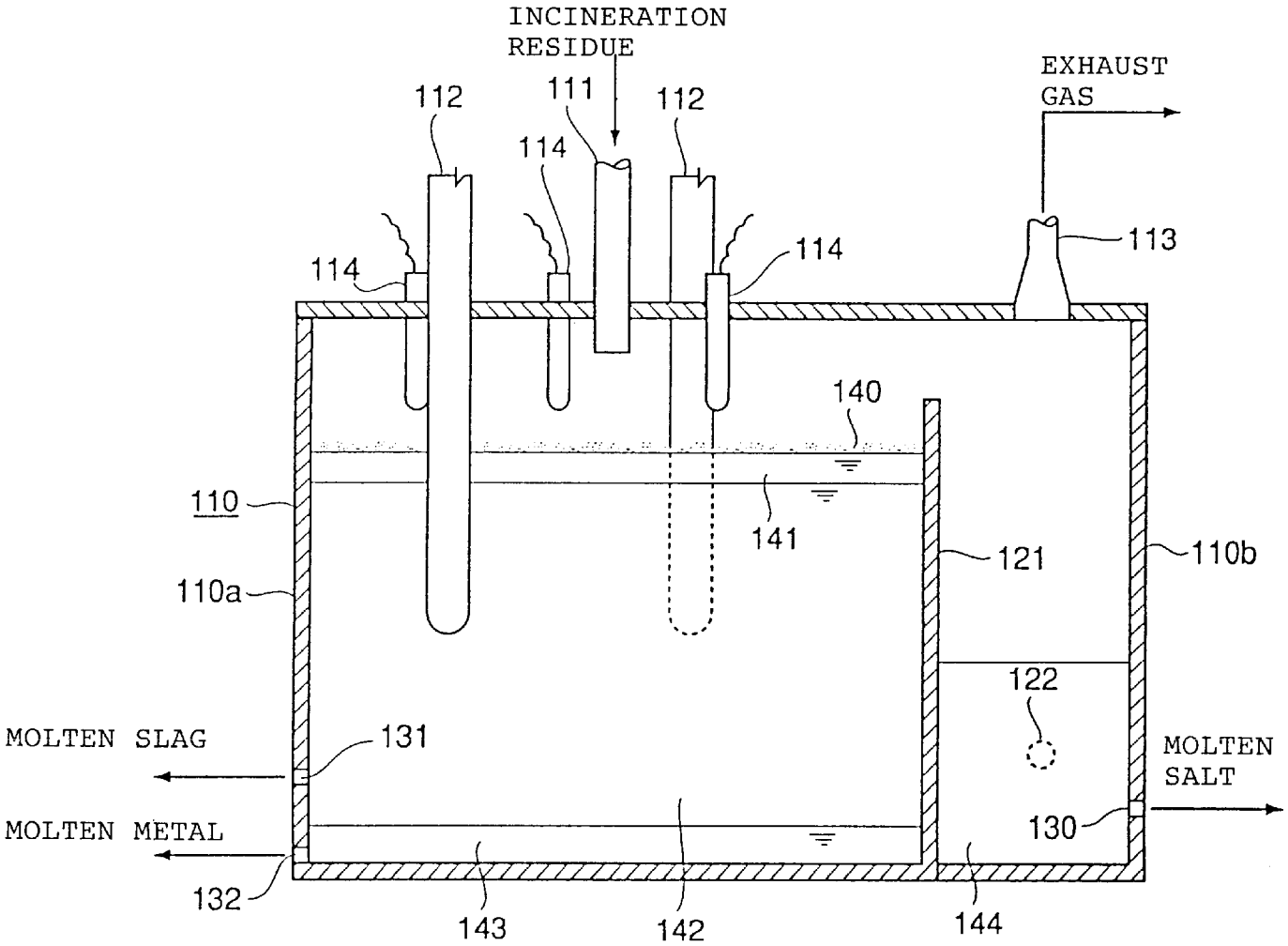
FIG. 14 is a plan view of a further melting furnace in accordance with best mode 2.

FIG. 14 is a sectional view showing a melting furnace in accordance with a further embodiment of the present invention. In FIG. 14, the same portions as FIGS. 12 and 13 are denoted by the same reference numerals, and description thereof is omitted. In this embodiment, the furnace body 110 is partitioned by a partition wall 121 having the upper end positioned at a height higher than the upper surface level of the melt stayed in the furnace to form two portions including the melting portion 110*a* and the molten salt discharge portion 110*b*.

In the melting furnace having the above construction, the molten salts of the molten salt layer formed in the melting portion 110*a* are all vaporized, condensed, collected in the molten salt discharge portion 110*b*, and then discharged through the molten salt discharge port 130. This facilitates control of the level of the melt in the operation of the melting furnace. Namely, in the case of the overflow system fractionation discharge of the molten salts, the molten salts overflow from the upper portion of the furnace, and the molten slag is discharged from the lower portion of the furnace. Therefore, in order to remove of the molten slag, it is necessary to control the amount of the molten slag removed so that the level of the boundary between the molten salt layer and the molten slag layer is appropriately lower than the upper end of the overflow weir, to prevent discharge of the molten slag together with the molten salts. However, in the melting furnace shown in FIG. 14, the molten salts are discharged without overflowing from the melting portion 110*a*, and thus it is unnecessary to strictly control the level of the melt. The partition wall 121 also functions to prohibit mixing of the incineration residue with the molten salts in the molten salt discharge portion 110*b*.

Next, the results of the operation of melting the incineration residue containing salts will be described below. The results of the operation using the furnace having the same construction as shown in FIGS. 12 and 13 showing the melting furnace of the present invention were as follows:

An incineration residue containing waste incineration ash and fly ash (the compositions are shown in Table 5) at a ratio of 7:3 was continuously charged and melted in an electric resistance melting furnace having a processing capacity of 200 kg/h at a feed rate of 200 kg/h. At this time, the vapor phase was heated by a heater comprising a silicon carbide heating element to maintain the temperature at about 800° C. The molten salts collected in the molten slat discharge portion was heated by the heater to maintain the temperature at about 850° C.

The amount of the exhaust gases during the operation was about 30 $Nm^3/h$ (water content 30%, temperature 80° C.). The dust concentration of the exhaust gases was about 40 $g/Nm^3$ (dry base). Table 6 shows the composition of the dust collected by the exhaust gas processing apparatus, and Table 3 shows the compositions of the molten salts discharged.

As a result of continuous operation, no trouble occurred due to clogging of the exhaust gas duct even after the elapse of 120 hours. The molten salts collected in the molten salt discharge portion had low viscosity, and thus could be smoothly discharged.

On the other hand, the results of the case using a conventional melting furnace in which no heater is provided in the vapor phase portion were as follows:

The exhaust gas duct started to be clogged after the elapse of 60 hours, deteriorating the suction state of exhaust gases. The compositions of the molten salts discharged during this operation were as shown in Table 7.

The results of the two operations under the above-described two conditions indicate that by heating the vapor phase portion in the furnace to maintain the temperature in the predetermined range, the occurrence of a trouble in the exhaust gas processing system can be prevented.

Comparison of the compositions of the two types of molten salts shown in Table 7 show that the molten salts discharged in the present invention contain small amounts of heavy metals such as Zn and Pb, as compared with the molten salts discharged by the conventional technique. This is due to the fact that the amount of vaporization of the heavy metal salts in the molten salts is increased, and the recovery rate of the vaporized alkali metal salts as molten salts is increased.

When the heavy metal content of the molten salts is decreased as described above, the amount of an expensive chemical added for making heavy metals insoluble in processing the molten salts, such as a liquid chelating agent or the like, is significantly decreased, thereby achieving a reduction in processing cost.

TABLE 5

| | (wt. %) | | | | | | | | |
|---|---|---|---|---|---|---|---|---|---|
| | Si | Al | Ca | Fe | Na | K | Cl | Zn | Pb |
| Incineration ash | 17.6 | 8.3 | 15.6 | 5.5 | 1.7 | 1.0 | 1.2 | 0.36 | 0.07 |
| Fly ash | 15.0 | 7.9 | 14.5 | 1.4 | 7.7 | 6.2 | 12.0 | 1.0 | 0.26 |

TABLE 6

| | (wt. %) | | | | | | |
|---|---|---|---|---|---|---|---|
| | Na | K | Ca | Cl | Zn | Pb | Cd |
| Dust | 11.5 | 9.2 | 0.41 | 26.1 | 35.6 | 7.3 | 0.4 |

TABLE 7

| | | (wt. %) | | | | | | |
|---|---|---|---|---|---|---|---|---|
| | | Na | K | Ca | Cl | Zn | Pb | Cd |
| Molten salt | This invention | 18.7 | 12.3 | 7.8 | 53.9 | 0.45 | 0.05 | less than 0.01 |
| | Conventional | 16.6 | 12.5 | 7.1 | 54.3 | 4.2 | 1.0 | less than 0.01 |

Best Mode 3

A method for melting an incineration residue containing salts in accordance with best mode 3 comprises the steps of:

charging an incineration residue containing salts to a melting furnace containing a melt;

melting the incineration residue; and blowing a non-oxidizing gas into a vapor phase in the melting furnace to increase the amount of the gases exhausted from the melting furnace.

In stead of the step blowing a non-oxidizing gas into the vapor phase in the melting furnace to increase the amount of the gases exhausted from the melting furnace, water may be supplied to the vapor phase in the melting furnace and vaporized to increase the amount of the exhaust gases exhausted from the melting furnace.

An apparatus for melting an incineration residue containing salts in accordance with best mode 3 comprises:

a melting furnace which contains a melt, and which is charged with the incineration residue containing salts; and a gas blowing pipe provided in the upper portion of the melting furnace, for blowing a gas into the vapor phase in the melting furnace.

In stead of the gas blowing pipe provided in the upper portion of the melting furnace, for blowing a gas into the vapor phase in the melting furnace, a water spray nozzle may be provided in the upper portion of the melting furnace, for spraying water into the vapor phase in the melting furnace.

The inventors studied various methods producing no molten salt layer in the melting furnace so as to avoid the occurrence of problems with the molten salts even when the incineration residue containing salts is melted.

Sinde there is the fact that a molten salt layer is still present in the furnace in spite of vaporization of the molten salts during melting, the behaviors of salts in the furnace were first studied. The incineration residue containing salts, such as an incineration residue of municipal solid waste, mainly comprises a mixture of oxides having melting points of 1300 to 1500° C., and salts having melting points of 700 to 800° C., such as sodium chloride, potassium chloride, and the like. The process for melting the incineration residue comprises melting all components contained in the incineration residue, and in an operation of the melting furnace, the incineration residue is thus heated to a high temperature region where all components are melted, i.e., a temperature higher than the melting points of the oxides. Therefore, the salts having low melting points are heated to a high temperature and vaporized. However, since the molten salt layer is covered with the unmelted incineration residue to inhibit heat transfer from the high-temperature melt due to the incineration residue. As a result, the temperature of the vapor phase in the furnace is significantly lower than that of the melt, and is at least a temperature lower than the boiling points of the salts. Therefore, in the vapor phase in the furnace, the salts vaporized from the molten salt layer are condensed and By solidified by cooling to produce fine particles.

However, as a result of examination of the amounts of the salts in dust collected by an exhaust gas dust collector, the amounts of the salts were small, and large amounts of the vaporized salts are not discharged but stay in the furnace. The fine salt particles are not discharged, but possibly increase in size during the time they float in the vapor phase in the furnace, and fall. The deposited salt particles are possibly melted together with the unmelted incineration residue to form molten salts, which are again vaporized.

In this way, large amounts of vaporized molted salts are not discharge, but are repeatedly condensed, solidified, fall, melted and vaporized to stay in the melting furnace. Therefore, in the furnace, melting is performed with the molten salt layer formed.

The reason why the particles of the salts vaporized from the molten salt layer are not discharged is that melting the incineration residue produces small amounts of gases, and the gases slowly flow, thereby causing stagnation or making the flow rate of gases flowing from the gas generation point toward the gas exhaust port lower than a flow rate which permits gas stream conveyance of the salt particles. Namely, in melting, gases are produced due to decomposition of organic materials in the incineration residue and vaporization of water, and thus the amounts of the gases produced are very small, generally about 150 to 200 $Nm^3$/hour per ton of incineration residue.

Therefore, in the present invention, the amounts of the gases discharged from the melting furnace are increased to discharge the particles of the salts vaporized from the molten salt layer to the outside of the furnace.

In order to increase the amounts of the gases exhausted from the melting furnace, a non-oxidizing gas may be blown into the furnace, or a material which is vaporized in the furnace of high temperature to produce a non-oxidizing gas, e.g., water, may be supplied.

In the present invention, the non-oxidizing gas represents a gas containing substantially no oxygen, such as nitrogen gas, combustible gas, water vapor, gas produced in a melting furnace operated in a reducing atmosphere, and the like. A combustion gas may be used. Examples of the combustible gas include petroleum gases, natural gases, city gases, and the like.

In supply of water, water may be sprayed directly in the furnace, or added to the incineration residue to be charged.

Figure 15:
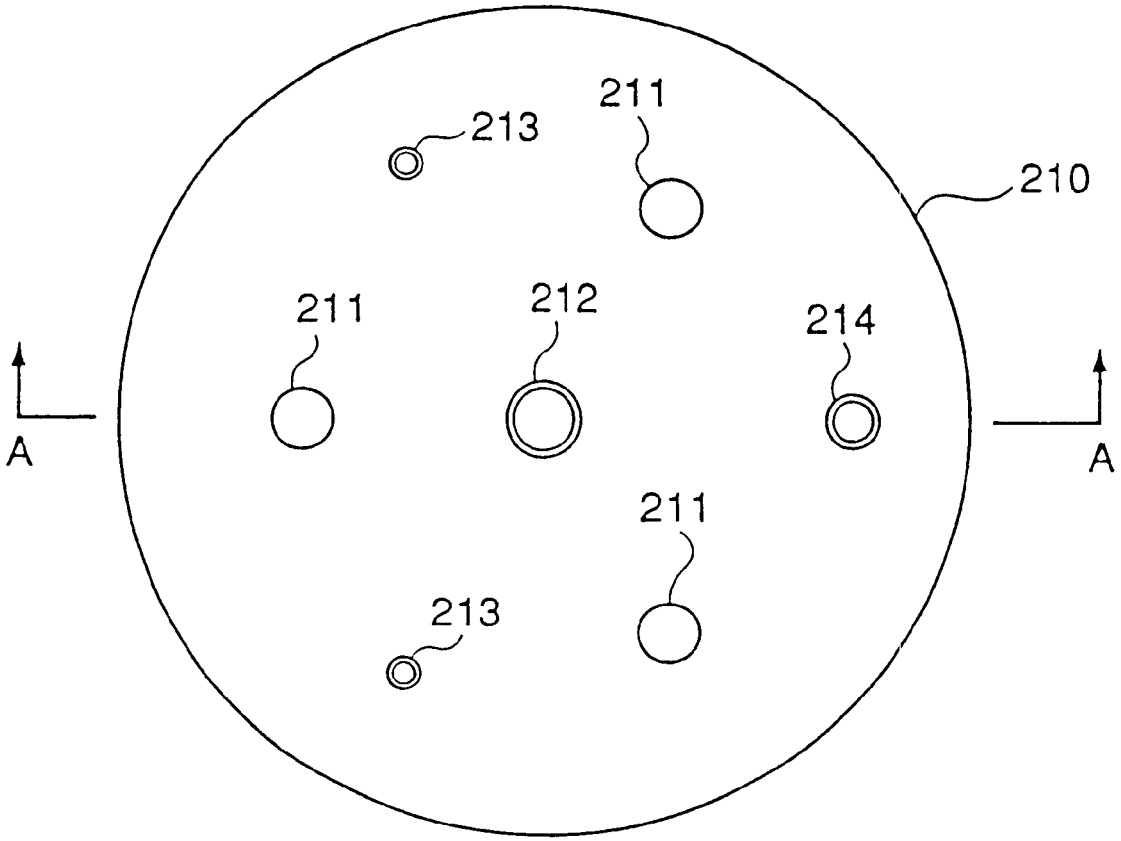
FIG. 15 is a plan view of a melting furnace in accordance with best mode 3.
Figure 16:
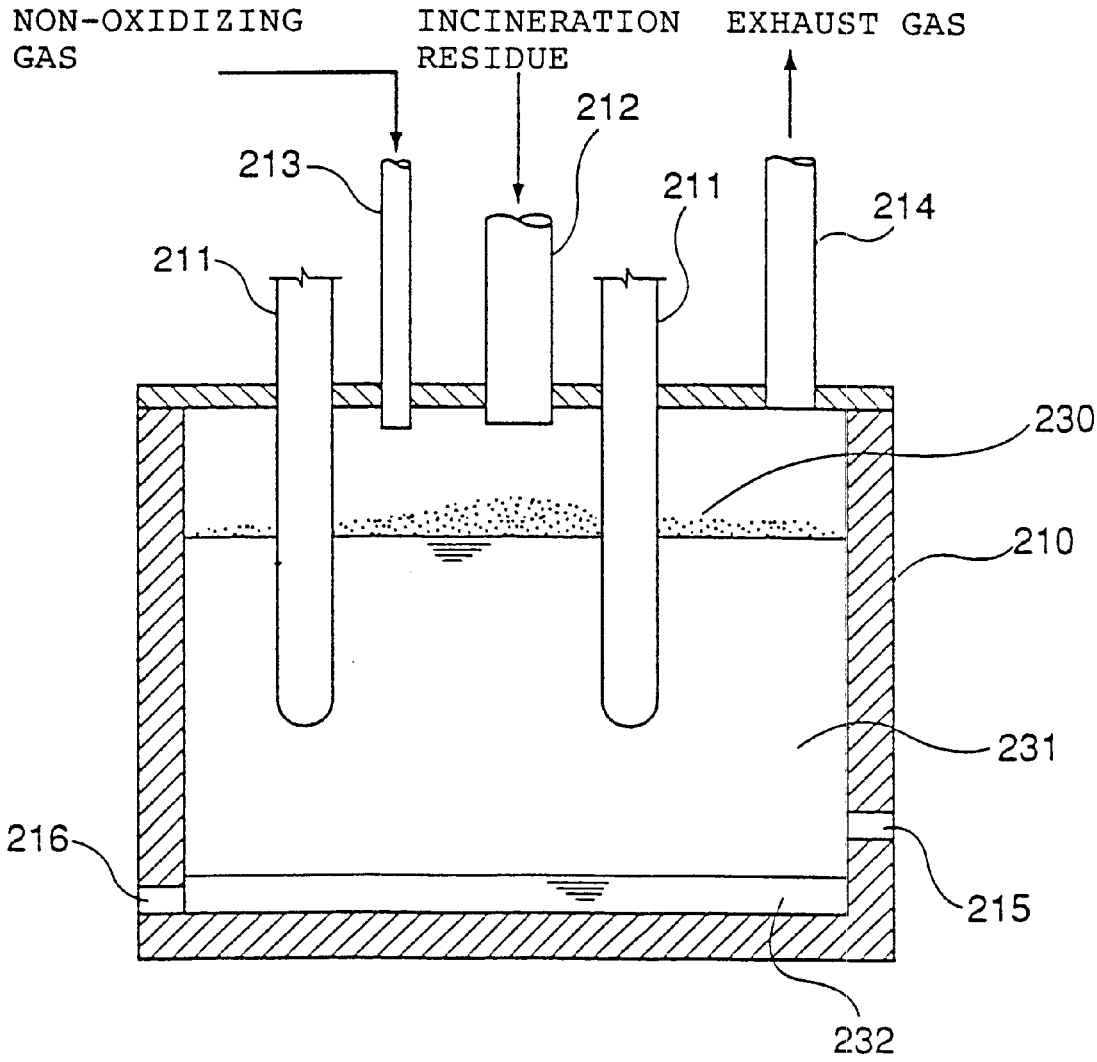
FIG. 16 is a sectional view taken along line A—A in FIG. 15.

FIG. 15 is a plan view showing a melting furnace in accordance with a further embodiment of the present invention, and FIG. 16 is a sectional view taken along line A—A in FIG. 15. The melting furnace shown in FIGS. 15 and 16 are an electric resistance type, in which reference numeral 210 denotes a body of the melting furnace; reference numeral 213, a molten slag layer; reference numeral 232, a molten metal layer; reference numeral 230, an incineration residue discharged to cover the molten slag layer. In FIGS. 15 and 16, reference numeral 211 denotes an electrode immersed in the molten salt to produce electric resistance heat; reference numeral 212, an inlet pipe for the incineration residue; reference numeral 213, a gas blowing pipe provided in the upper portion of the furnace, for blowing a non-oxidizing gas into the vapor phase; reference numeral 214, an exhaust pipe for exhausting gases. Reference numeral 215 denotes a discharge port for discharging molten slag, and reference numeral 216 denotes a discharge port for discharging molten metals.

The operation of melting the incineration residue containing salts by the melting furnace having the above-described construction is performed as follows:

The incineration residue is charged to the furnace in which the molten slag 231 heated by a current passed between the electrodes 211 to be maintained at 1300 to 1400° C., and melted. The incineration residue is charged to the furnace through the incineration residue inlet pipe 212 to cover the molten slag 231. The incineration residue 230 which covers the molten slag is successively melted from the lower portion thereof by pre-heating due to the heat transmitted from the molten slag. In melting the incineration residue, the components thereof are separated into molten salts, molten slag, and molten metals by differences in specific gravity. However, as described above, the molten salts produced in melting the incineration residue are heated to a high temperature and successively vaporized, and thus only small amounts of molten salts are present on the molten slag layer 231. Therefore, the molten slag layer 231 and the molten metal layer 232 are substantially formed in the furnace. The molten slag is continuously or intermittently discharged through the slag discharge port 215. The molten metals are intermittently discharged through the metal discharge port 216.

In this melting process, a non-oxidizing gas such as nitrogen gas, combustible gas, or the like is blown through the gas blowing pipes 213 to increase the amounts of the gases exhausted from the gas exhaust pipe 214. Blowing the gas forms a stream flowing toward the gas exhaust port 214 at each of positions in the vapor phase in the furnace. The particles of the salts vaporized are conveyed by the streams, and discharged to the outside of the furnace through the gas exhaust port 214.

In the operation of the electric resistance type or induction heating type melting furnace for melting with a melt stayed therein, the inside of the furnace is maintained in a reducing atmosphere, and thus the gas blown in the furnace is limited to non-oxidizing gases. Besides nitrogen gas and combustible gas, non-oxidizing gases include water vapor.

Figure 17:
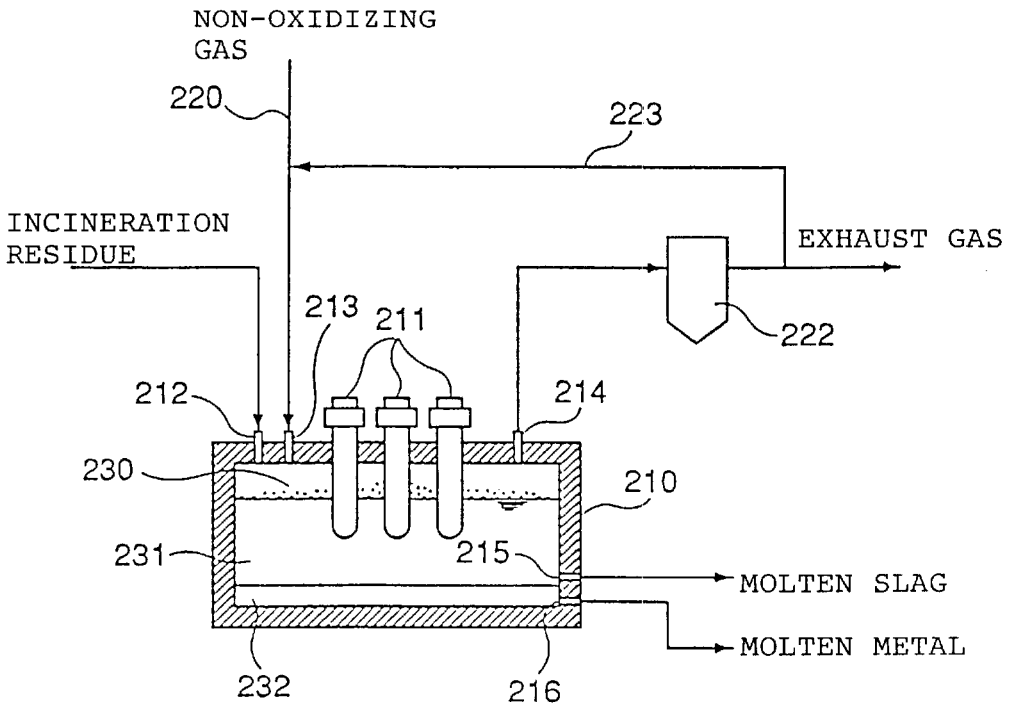
FIG. 17 is a plan view of another melting furnace in accordance with best mode 3.

FIG. 17 is a drawing showing a still further embodiment of the present invention. In FIG. 17, reference numeral 210 denotes a body of an electric resistance type melting furnace; reference numeral 231, a molten slag layer; reference numeral 232, a molten metal layer; reference numeral 230, an incineration residue which covers the molten slag layer. Reference numeral 211 denotes an electrode immersed in molten slag; reference numeral 212, an inlet pipe for the incineration residue; reference numeral 213, a gas blowing pipe; reference numeral 214, an exhaust pipe for exhaust gases; reference numeral 215, a discharge port for the molten slag; reference numeral 216, a discharge port for molten metals.

In this embodiment, an exhaust gas pipe connected to the outlet side of a dust collector 222 provided in an exhaust gas line is branched so that an exhaust gas return pipe 223 is provided and connected to a non-oxidizing gas pipe 220. Therefore, the reducing exhaust gases exhausted from the melting furnace can be blown as non-oxidizing gases into the furnace. In blowing the exhaust gases, the exhaust gases are preferably used as a portion of the non-oxidizing gas such as nitrogen gas, combustible gas, or the like.

Figure 18:
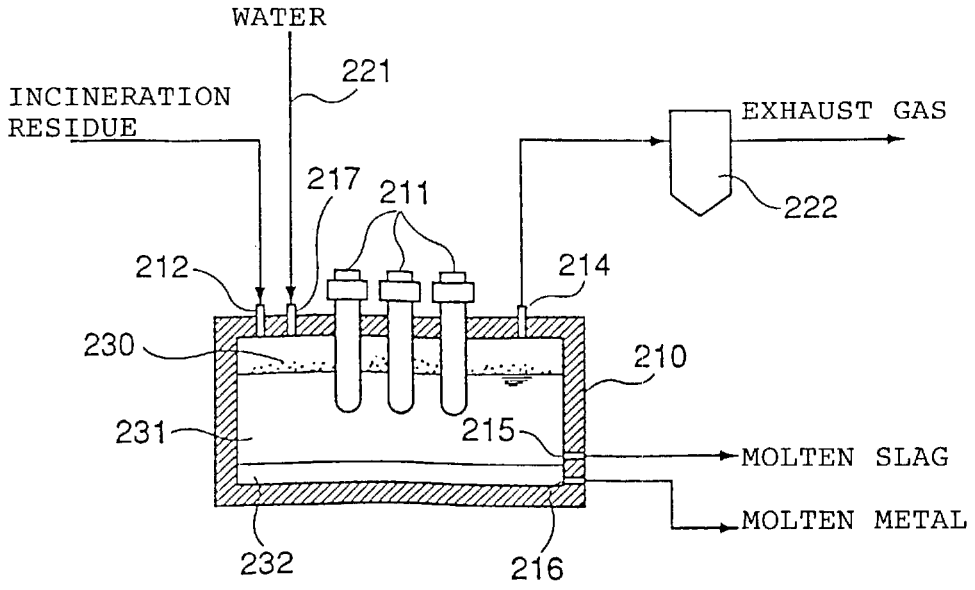
FIG. 18 is a plan view of a further melting furnace in accordance with best mode 3.

FIG. 18 is a drawing showing a further embodiment of the present invention. In FIG. 18, the same portions as FIG. 17 are denoted by the same reference numerals, and description thereof is omitted. In this embodiment, a water spray nozzle 217 is provided in the upper portion of the furnace. Reference numeral 221 denotes a water pipe connected to the water spray nozzle 217. Therefore, water can be sprayed in the furnace of high temperature, and vaporized to increase the amounts of the gases produced.

In this way, the amounts of the exhaust gases can be increased by supplying water into the furnace of high temperature. However, means for supplying water into the furnace is not limited to spray into the furnace, and a predetermined amount of water may be added to the incineration residue.

Next, description will be made of the results of gas blowing into the melting furnace during the process of melting the incineration residue containing salts.

In an electric resistance type melting furnace (inner diameter 2.8 m×height 2.0 m, processing capacity 1 t/h) having the same construction as FIGS. 15 and 16, comprising a gas blowing pipe, a nitrogen gas was blown through the gas blowing pipe under continuous charge and melting of an incineration residue containing dust incineration ash and fly ash (the compositions shown in Table 8) at a ratio of 7:3 at a feed rate of 1 t/h. The flow rate of the nitrogen gas blown was 100 $Nm^3/h$. At this time, the flow of the exhaust gases from the melting furnace was 760 $m^{3/}h$ (water content 20%, temperature 400° C., flow rate 250 $Nm^3/h$ in terms of dry base). The dust concentration of the exhaust gases was 129 $g/Nm^3$ (dry base), and the composition of the dust collected was as shown in Table 9. Therefore, the amount of the dust discharged from the melting furnace was 32 kg/h. In the continuous operation with the nitrogen gas blown, no abnormality occurred in the operation due to a current increase or the like even after the elapse of 24 hours.

On the other hand, without gas blowing (conventional operation), the flow rate of the exhaust gases was 520 m3/h (water content 29%, temperature 400° C., the flow rate 150 $Nm^3/h$ in terms of dry base), and the dust content of the gases was 82 $g/Nm^3$ (dry base). Therefore, the amount of the dust discharged from the melting furnace was 12 kg/h. The current started to increase after the elapse of 6 hours, and supply of power was made impossible after the elapse of 18 hours. At this time, the molten salt layer was produced in the melting furnace.

It was thus confirmed that the vaporized salts can be discharged by blowing a gas into the melting furnace, and thus no molten slat layer is formed in the furnace, thereby causing no abnormality in the operation due to an increase in current.

TABLE 8

| | (wt. %) | | | | | | | | |
|---|---|---|---|---|---|---|---|---|---|
| | Si | Al | Ca | Fe | Na | K | Cl | Zn | Pb |
| Incineration ash | 17.6 | 8.3 | 15.6 | 5.5 | 1.7 | 1.0 | 1.2 | 0.36 | 0.07 |
| Fly ash | 15.0 | 7.9 | 14.5 | 1.4 | 7.7 | 6.2 | 12.0 | 1.0 | 0.26 |

TABLE 9

| | (wt. %) | | | | | | | | |
|---|---|---|---|---|---|---|---|---|---|
| | Si | Al | Ca | Fe | Na | K | Cl | Zn | Pb |
| Dust | 0.76 | 0.16 | 0.54 | 0.09 | 19.7 | 12.4 | 41.6 | 17.9 | 4.1 |

What is claimed is:

1. A method for melting an incineration residue containing salts comprising the steps of:

adding a component adjustor to an incineration residue containing salts to adjust a component molar ratio determined by the following equation in the range of 0.7 to 2.0:

component molar ratio=(Ca+Mg)/(Si+Al);

charging the incineration residue having an adjusted component molar ratio into a melting furnace maintained in a reducing atmosphere, and melting the incineration residue to form a melt;

maintaining the melt in the melting furnace to separate the melt into a molten slag layer, a molten salt layer and a molten metal layer;

fractionating the molten slag and discharging the molten slag; and rapidly cooling the discharged molten slag.

2. The method for melting an incineration residue according to claim 1, wherein the component adjustor is a component adjustor containing Ca.

3. The method for melting an incineration residue according to claim 1, wherein the component adjustor is a component adjustor containing Mg.

4. The method for melting an incineration residue according to claim 1, wherein the component adjustor is a component adjustor containing Ca and Mg.

5. The method for melting an incineration residue according to claim 1, wherein the component adjustor is a component adjustor containing Si.

6. The method for melting an incineration residue according to claim 1, wherein the component adjustor is a component adjustor containing Al.

7. The method for melting an incineration residue according to claim 1, wherein the component adjustor is a component adjustor containing Si and Al.

8. The method for melting an incineration residue according to claim 1, wherein the step of rapidly cooling the molten slag comprises rapidly cooling the molten slag by contact with water.

9. The method for melting an incineration residue according to claim 1, wherein the step of rapidly cooling the molten slag comprises rapidly cooling the molten slag by contact with a water-cooled metallic surface.

10. The method for melting an incineration residue according to claim 1, wherein the step of rapidly cooling the molten slag comprises supplying the molten slag onto a peripheral surface of a water-cooled metallic drum.

11. The method for melting an incineration residue according to claim 1, wherein the step of rapidly cooling the molten slag comprises supplying the molten slag onto a peripheral surface of a water-cooled metallic roll.

12. A method for melting an incineration residue containing salts comprising the steps of:

charging an incineration residue containing salts into a melting furnace which contains a vapor phase and a melt;

melting the incineration residue; and maintaining the vapor phase in the melting furnace at a temperature of 700 to 1000° C.

13. The method for melting an incineration residue according to claim 12, wherein the step of maintaining the vapor phase at a temperature of 700 to 1000° C. comprises heating the vapor phase in the melting furnace.

14. A melting apparatus for melting an incineration residue containing salts comprising:

a melting furnace which is charged with an incineration residue containing salts, and which contains a vapor phase and a melt, the melt comprising molten salts, molten slag and molten metals, the melting furnace being provided with a molten salt discharge port for discharging the molten salts, a molten slag discharge port for discharging the molten slag and a molten metal discharge port for discharging the molten metals;

a heater for controlling the temperature of the vapor phase in the melting furnace; and a submerged weir for discharging the molten salts, the submerged weir being disposed in an upper portion of the melting apparatus on a side where the molten salt discharge port is provided, the submerged weir having (i) a lower end at a position lower than a height corresponding to a hot water level which is formed during formation of the molten salt, and (ii) an open upper portion.

15. A method for melting an incineration residue containing salts, comprising the steps of:

charging an incineration residue containing salts to a melting furnace which contains a melt;

melting the incineration residue; and supplying water to the vapor phase in the melting furnace to increase the amounts of the exhaust gases exhausted from the melting furnace.

16. An apparatus for melting an incineration residue containing salts comprising:

a melting furnace which contains a vapor phase and a melt, and which is charged with an incineration residue containing salts, the melting furnace being provided with a molten slag discharge port for discharging molten slag and a molten metal discharge portion for discharging molten metal; and a water spray nozzle provided in an upper portion of the melting furnace for spraying water into the vapor phase in the melting furnace.

* * * * *